US005641620A

United States Patent [19]

Yamashita et al.

[11] Patent Number: 5,641,620

[45] Date of Patent: Jun. 24, 1997

[54] SILVER HALIDE EMULSION, PROCESS FOR PREPARING THE SAME, AND SILVER HALIDE PHOTOGRAPHIC MATERIALS CONTAINING THE SAME

[75] Inventors: Seiji Yamashita; Takayoshi Oyamada; Mitsuo Saitou, all of Minami Ashigara, Japan

[73] Assignee: Fuji Photo Film Co., Ltd., Kanagawa, Japan

[21] Appl. No.: 548,832

[22] Filed: Oct. 26, 1995

[30] Foreign Application Priority Data

Oct. 26, 1994 [JP] Japan ..... 6-262589
Oct. 26, 1994 [JP] Japan ..... 6-262590

[51] Int. Cl.[6] ..... G03C 1/015; G03C 1/035

[52] U.S. Cl. ..... 430/569; 430/567

[58] Field of Search ..... 430/569, 567

[56] References Cited

U.S. PATENT DOCUMENTS 5,314,798 5/1994 Brust et al. ..... 430/567
5,380,641 1/1995 Urabe et al. ..... 430/569
5,413,904 5/1995 Chang et al. ..... 430/569

*Primary Examiner*—Mark F. Huff

*Attorney, Agent, or Firm*—Birch, Stewart, Kolasch & Birch, LLP

[57] ABSTRACT

A process for producing a silver halide emulsion comprising tabular silver halide grains containing not less than 10 mol% of silver chloride and having {100} faces as major faces and an average aspect ratio of 2 or higher, which tabular silver halide grains are prepared by comprising rising temperature of a grain formation system after completion of (a) nucleation step and taking (c) grain growth step, which process comprises adding silver ions in an amount corresponding to at least 1 mol% of the total silver content to the silver halide emulsion at a stage after introduction of a halogen gap in the nucleation step (a) and before the grain growth step (c).

18 Claims, No Drawings

SILVER HALIDE EMULSION, PROCESS FOR PREPARING THE SAME, AND SILVER HALIDE PHOTOGRAPHIC MATERIALS CONTAINING THE SAME

FIELD OF THE INVENTION

This invention relates to a monodisperse silver halide emulsion comprising tabular silver halide grains having a high silver chloride content and comprising {100} faces as major faces at a high aspect ratio, a process for preparing the emulsion, and a medical X-ray photographic material containing the emulsion.

BACKGROUND OF THE INVENTION

It is well known that tabular silver halide grains having a high aspect ratio have high covering power, i.e., provide a high developed silver concentration per unit silver coverage, and there has been a demand for tabular grains having a further increased aspect ratio.

On the other hand, silver halide photographic materials containing a silver halide emulsion having a high silver chloride content have been in demand for achieving rapid processing and low-throughout replenishment.

Processes for preparing tabular grains having {100} faces as major faces (hereinafter referred to as {100} tabular grains) are described in detail in JP-A-5-204073 (the term "JP-A" as used herein means an "unexamined published Japanese patent application"), JP-A-6-5936 and U.S. Pat. Nos. 4,063,951, 4,386,156, 5,275,930, 5,264,337, and 5,292,632. In these publications we can find, in particular, processes for producing {100} tabular silver chlorobromide grains, in which {100} tabular nuclei are formed by double jet addition of silver ions and chloride ions (with or without a trace of iodide ions) in the presence of chloride ions and a trace of iodide ions, or processes in which AgCl crystallite nuclei are previously formed and immediately thereafter silver ions and bromide ions (with or without chloride ions) are added to introduce a gap of halogen composition (halogen gap) thereby to form {100} tabular nuclei showing anisotropic growth.

The above-mentioned nucleus formation is generally followed by physical ripening and further growth. The growth step is often conducted at an elevated temperature to accelerate the growth.

The inventors of the present invention found the following very important for achieving a high aspect ratio and a monodispersion in the formation of silver chlorobromide {100} tabular grains:

(1) Between introduction of a halogen gap (formation of halogen nuclei of different halogen composition) and before the subsequent physical ripening-growth step, a step of depositing a silver halide phase which is more easily soluble than the phase so far built up is inserted to stabilize the {100} tabular nuclei. As a result, a large number of uniform nuclei can be obtained. That is, a nucleation step includes this step.

(2) Anisotropic growth is accelerated under a low supersaturation condition. To this effect, it is desirable to conduct crystal growth at as high a temperature as possible.

(3) While anisotropic growth is accelerated in the presence of fine grains, the anisotropic growth would be impaired if the fine grains have a wide size distribution.

While JP-A-5-204073, JP-A-6-5936, and U.S. Pat. Nos. 5,275,930, 5,264,337, and 5,292,632 relate to {100} tabular grains having a high silver chloride content, little was it expected that deposition of silver halide prior to ripening would be of importance for monodispersion and stabilization of {100} tabular nuclei and achievement of a high aspect ratio of {100} tabular nuclei.

Neither was it expected to be important that the deposition be conducted within 10 minutes after formation of nuclei having a halogen gap, i.e., before ripening proceeds.

Further, although a mention of grain growth by addition of fine grains is given in JP-A-6-5936, importance of the degree of monodispersion of the fine grains for acceleration of anisotropic growth or monodispersion of silver chlorobromide {100} tabular grains was far beyond anticipation.

SUMMARY OF THE INVENTION

An object of the present invention is to provide a {100} tabular silver halide emulsion having a high silver chloride content in which the tabular grains have a high aspect ratio and a high degree of monodispersion.

Another object of the present invention is to provide a medical X-ray photographic material containing the emulsion, which material is excellent in suitability to rapid processing and low-throughout replenishment.

A further object of the present invention is to provide a silver halide emulsion, the silver halide grains of which have been formed with satisfactory anisotropic growth (i.e., at a very low growth speed in the thickness direction) and with a high degree of monodispersion, and which emulsion is excellent in sensitivity, graininess and spectral sensitivity characteristics; and to provide a photographic material containing the emulsion.

The inventors of the present invention have found that the above objects are accomplished by the following embodiments.

(1) A process for producing a silver halide emulsion comprising tabular silver halide grains containing not less than 10 mol% of silver chloride and having {100} faces as major faces and an average aspect ratio of 2 or higher, which tabular silver halide grains are prepared by comprising rising temperature of a grain formation system after completion of (a) nucleation step and taking (c) grain growth step, which process comprises adding silver ions in an amount corresponding to at least 1 mol% of the total silver content to the silver halide emulsion at a stage after introduction of a halogen gap in the nucleation step (a) and before the grain growth step (c).

(2) The process for producing the silver halide emulsion according to (1), wherein the addition of silver ions is conducted within 10 minutes after introduction of a halogen gap.

(3) The process for producing the silver halide emulsion according to (1), wherein the grain growth step (c) is carried out at a temperature higher than that of the nucleation step (a) by at least 20° C.

(4) A process for producing a silver halide emulsion comprising tabular silver halide grains containing not less than 10 mol% of silver chloride and having {100} faces as major faces and an average aspect ratio of 2 or higher, which tabular silver halide grains are prepared by comprising rising temperature of a grain formation system after completion of (a) nucleation step and taking (c) grain growth step, which process comprises allowing {100} tabular grains after completion of the nucleation step (a) to grow in the presence of a fine-grain emulsion having a coefficient of grain size variation of not more than 15%.

(5) The process for producing the silver halide emulsion according to (1), wherein silver halide grains are allowed to grow by addition of fine grains at least 90% of which are capable of disappearance, with not less than 50% by number of all the added fine grains, when counted in the descending order of volume, being those having a volume falling within a range of 70 to 100% of the maximum volume of the grains capable of disappearance during the grain growth.

(6) The process for producing the silver halide emulsion according to (1), wherein grain growth after addition of 30% of the total silver content is carried out by adding a silver salt and a halogen salt under conditions of pCl of 1.6 or more and a temperature of 65° C. or higher at such a rate of addition that new nuclei may be formed and that the new nuclei may not grow to such a size that could not disappear ultimately.

(7) The process for producing the silver halide emulsion according to (1), wherein pure silver chloride grains or silver halide grains containing not less than 10 mol% of chlorine having a coefficient of volume variation of not more than 0.2 and each having a volume of not greater than 0.001 $\mu m^3$ are used as seed crystals and said tabular grains have a coefficient of variation of not more than 0.25.

(8) The process for producing the silver halide emulsion according to (6), wherein not less than 70% by number of all the added fine grains, when counted in the descending order of volume, are those having a volume falling within a range of 70 to 100% of the maximum volume of the fine grains capable of disappearance during the grain growth.

(9) The process for producing the silver halide emulsion according to (1), wherein said tabular silver halide grains contain 20 to 99 mol% of silver chloride.

(10) The process for producing the silver halide emulsion according to (7), wherein said seed crystals have a coefficient of volume variation of not more than 0.1.

(11) The process for producing the silver halide emulsion according to (1), wherein (b) ripening step is carried out after the rising temperature and before the grain growth step (c).

(12) A silver halide photographic material comprising a support having thereon at least one layer containing a silver halide emulsion comprising tabular silver halide grains containing not less than 10 mol% of silver chloride and having {100} faces as major faces and an average aspect ratio of 2 or higher, which tabular silver halide grains are prepared by comprising rising temperature of a grain formation system after completion of (a) nucleation step and taking (c) grain growth step, and further comprising adding silver ions in an amount corresponding to at least 1 mol% of the total silver content to the grain formation system at a stage after introduction of a halogen gap in the nucleation step (a) and before the grain growth step (c).

(13) A silver halide photographic material comprising a support having on each side thereof a layer containing a silver halide emulsion comprising tabular silver halide grains containing not less than 10 mol% of silver chloride and having {100} faces as major faces and an average aspect ratio of 2 or higher, which tabular silver halide grains are prepared by comprising rising temperature of a grain formation system after completion of (a) nucleation step and taking (c) grain growth step, and further comprising adding silver ions in an amount corresponding to at least 1 mol% of the total silver content to the grain formation system at a stage after introduction of a halogen gap in the nucleation step (a) and before the grain growth step (c).

DETAILED DESCRIPTION OF THE INVENTION

The process for preparing {100} tabular grains having a high silver chloride content (hereinafter simply referred to high-AgCl {100} tabular grains) comprises rising temperature of a system after completion of (a) nucleation step and taking (c) grain growth step, if necessary, after (b) ripening step.

Nucleation step (a) is a step of adding silver ions and halide ions to form silver halide fine grains (nuclei). Nucleation step (a) is further divided into (a-1) nucleus formation step, (a-2) halogen gap introduction step, and (a-3) stabilization step.

Halogen gap introduction step (a-2) is a step of adding a halogen (e.g., Br) different from the halogen constituting the nuclei formed in step (a-1) (e.g., Cl) to form heterogeneous mixed silver halide crystals.

Formation of heterogeneous mixed crystals is achieved by combining steps (a-1) and (a-2) carried out either independently in this order or simultaneously. For example, heterogeneous mixed silver halide crystals can be formed by adding and mixing an aqueous solution containing silver ions and an aqueous solution containing two kinds of halide ions abruptly in a short time. The term "heterogeneous mixed silver halide crystals" as used herein means individual silver halide mixed crystals having non-uniform distribution of two kinds of halide ions.

High-AgCl {100} tabular grains are described in JP-A-5-204073, JP-A-6-5936, and U.S. Pat. Nos. 5,275,930, 5,264,337, and 5,292,632. These publications disclose techniques of forming mixed crystals of different halogens or of introducing a halogen gap in the form, e.g., of AgCl/AgI or AgCl/AgBr and thereby forming nuclei capable of growing anisotropically into tabular grains. Any of these known nucleation techniques can be used arbitrarily in the present invention.

Stabilization step (a-3) is a step in which silver ions and halide ions are further added to the nucleation system to deposit silver halide on the nuclei having a halogen gap introduced therein, thereby to stabilize the nuclei.

The most preferred embodiment of the present invention resides in that the amount of silver ions added in stabilization step (a-3) is not less than 1 mol%, preferably from 1 to 10 mol%, still preferably 2 to 8 mol%, based on the total silver content. In this stabilization step silver ions or both silver ions and halide ions are added so that a layer having higher solubility (i.e., a higher chlorine content) than the previously formed nuclei may be deposited.

The stabilization step is preferably performed within 10 minutes, still preferably between 10 seconds and 5 minutes, particularly preferably between 10 seconds and 3 minutes, from the introduction of a halogen gap.

In the present invention, the addition of silver ions is preferably completed between 1 second and 10 minutes, more preferably between 5 seconds and 5 minutes, particularly preferably between 15 seconds and 3 minutes, from the introduction of a halogen gap.

The stabilization step is followed by ripening and then grain growth is started. The elapse of time before the start of growth is preferably within 30 minutes.

Ripening step (b) is a step in which the temperature of the silver halide emulsion in a reaction vessel is raised after completion of nucleation step (a) to conduct physical ripening. In the preferred embodiment of the present invention, no silver ion is added in this step. The temperature is preferably raised by 10° to 45° C., more preferably at least 20° C., still preferably 20° to 40° C..

Ripening step (b) is not essential to the present invention. It is possible that the temperature is raised after completion of nucleation step (a) and immediately thereafter the system is transferred to grain growth step (c). However, it is preferable to take ripening step (b) between nucleation step (a) and grain growth step (c).

Nucleation step is preferably carried out at a temperature of from 20° to 80° C., more preferably from 20° to 60° C., particularly preferably from 25° to 50° C. Ripening step and grain growth step each is preferably carried out at a temperature of from 50° to 90° C., more preferably from 55° to 85° C., particularly preferably from 65 to 80° C. However, grain growth step is preferably carried out at a temperature higher than that of nucleation step by 10° to 45° C., more preferably by at least 20° C., particularly preferably by 20° to 40° C.

Grain growth step (c) is a step taken after completion of nucleation step (a) and temperature rise and, if necessary, after ripening step (b). In this step fresh silver and halogen are added to allow the silver halide grains to grow. In the present invention the grain growth step is preferably conducted in the presence of fine silver halide grains.

The following is the details of crystal growth through physical ripening (fine grains dissolve to let the basic grains grow) in the presence of silver halide fine grains.

An emulsion of AgX fine grains having a grain size of not greater than 0.20 μm, preferably not greater than 0.15 μm, still preferably from 0.01 to 0.15 μm, is added to allow the basic grains to grow through Ostwald ripening. The fine-grain emulsion may be added either continuously or intermittently. The fine-grain emulsion may be continuously prepared by feeding a silver nitrate solution and a halide solution to a mixer placed near the reaction vessel and continuously supplied to the reaction vessel. Otherwise the emulsion may be prepared batchwise in a separate container and added to the reaction vessel continuously or intermittently. The fine-grain emulsion to be added may be used in the form of liquid or dry powder. The dry powder may be liquefied by mixing with water on use.

In the case where grain growth is effected by continuously adding a silver nitrate solution and a halide solution to the reaction system, for example, according to a double jet process, the solubility of the system is controlled so as to form fine grains temporarily (re-nucleation), which dissolve in the system to allow the basic {100} tabular grains to grow.

The fine grains which always co-exist with growing {100} tabular grains preferably have a coefficient of size variation, in terms of average sphere-equivalent diameter, of not more than 15%, still preferably not more than 10%, and particularly preferably not more than 5%.

When a degree of monodispersion of a silver halide emulsion is expressed in terms of the coefficient of variation as defined in JP-A-59-745481, the emulsion of the present invention preferably has that coefficient of variation of not more than 30%, still preferably from 5 to 25%. For particular use in high-contrast light-sensitive materials, the coefficient of variation is preferably 5 to 15%.

The term "aspect ratio" as used herein for tabular grains denotes a ratio of a circle-equivalent diameter of a projected area to a thickness. The term "projected area" denotes a projected area of a tabular grain as observed under an electron microscope, the grains being arranged on a plane without overlapping each other with their major faces in parallel with the plane. The term "circle-equivalent diameter" means a diameter of a circle having the same area as the projected area of grain. The term "thickness" indicates the length of the shortest edge of the tabular grains. The term "average aspect ratio" means a statistical average of the aspect ratios of all the grains.

The tabular silver halide grains of the present invention preferably have an aspect ratio of 5 or more, still preferably from 8 to 20. An average thickness of the tabular grains is preferably not more than 0.5 μm, more preferably not more than 0.3 μm, still preferably from 0.03 to 0.2 μm, particularly preferably from 0.05 to 0.2 μm. Such a small thickness realizes a high aspect ratio for small-sized grains, thereby achieving high covering power (high developed silver concentration per unit developed silver amount).

A projected area circle-equivalent diameter of the tabular silver halide grains is preferably not more than 10 μm, more preferably from 0.2 to 5 μm. It is desirable that the circle-equivalent diameter has narrow distribution (i.e., monodisperse), and the coefficient of variation of the distribution preferably ranges from 0 to 0.4, still preferably from 0 to 0.3, and particularly preferably from 0 to 0.2. The term "coefficient of variation" as used with respect to the degree of monodispersion is a value obtained by dividing a variation of grain size, as expressed in terms of a projected area circle-equivalent diameter, (standard deviation) by a mean grain size.

Any two adjoining sides forming the major faces of the tabular grains preferably have a length ratio of 1:3 to 1:1 in average. If one of the adjoining sides of the major faces is too short as close to the grain thickness, the grain fails to have a high aspect ratio only to have reduced covering power. From this viewpoint, a particularly preferred length ratio of adjoining sides is from 1:2 to 1:1 in average.

The emulsion grains preferably have a silver iodide content of not more than 1 mol%, still preferably not more than 0.5 mol%, and preferably have a silver bromide content of 1 to 90 mol%, still preferably 1 to 60 mol%.

In the silver halide emulsion containing at least a dispersing medium and silver halide grains, at least 50%, preferably 60 to 99%, still preferably 70 to 99%, in terms of projected area, of the total silver halide grains should be tabular grains having {100} faces as major faces and having a chloride ion content of not less than 10 mol%, preferably 20 to 99 mol%, still preferably 30 to 90 mol%, particularly preferably 40 to 80 mol%.

The emulsion as prepared through steps (a) to (c) is washed with water and chemically sensitized. The emulsion of the present invention is preferably sensitized by selenium and/or tellurium sensitization.

Examples of preferred usage and compounds useful in selenium and/or tellurium sensitization are given in JP-A-3-116132, JP-A-5-113635, JP-A-5-165136, JP-A-5-165137, and JP-A-5-134345. Particularly preferred selenium sensitizes include the compounds represented by formula (I) or (II) described in JP-A-5-165137, especially compounds I-1 to 1-20 and compounds II-1 to II-19; and particularly preferred tellurium sensitizes include the compounds represented by formula (IV) or (V) described in JP-A-5-134345, especially compounds IV-1 to IV-22 and compounds V-1 to V-16.

In order to form tabular crystals, it is necessary that a crystal defect like a screw dislocation be induced at the time of nucleation to accelerate growth in a specific direction. While not necessarily identified, probability is that the above-mentioned crystal defect is a screw dislocation seeing from the direction the dislocation is introduced in and from the fact that the grains are endowed with anisotropic growth properties.

The term "grain growth" as used herein covers all the stages after 30% or more of silver based on the total silver content has been added. It is not necessary that a clear halogen gap, etc. should be present between nucleation/ripening and growth.

The silver halide grains according to the present invention are characterized in that the anisotropic growth thereof is effected with silver halide fine grains capable of disappearance.

The fine grains to be added preferably have a chlorine content of not less than 50%, still preferably not less than 70%, and particularly preferably not less than 90%. Before tabular grains grow with anisotropy it is essential to carry out the growth under such conditions that the tabular grains per se may not dissolve and under a low supersaturation condition. To this effect, the fine grains to be added are preferably as large as possible as long as they disappear by the time of completion of grain formation (such a maximum size will hereinafter referred to as a critical grain size, and grains of that size will hereinafter be referred to as critical fine grains). Since the degree of supersaturation is decided by the solubility of the grains, the larger the grains, the more readily is the low supersaturation state is realized. Further, the existence of the fine grains prevents the tabular grains per se from dissolving. Accordingly, it is preferable that not less than 90%, preferably not less than 95%, still preferably 100%, of the number of the total added grains are not greater than the critical grain size and that fine grains whose volume falls within a range of from 70 to 100%, preferably from 80 to 100%, still preferably from 90 to 100%, of the critical grain size be used. When all the fine grains are counted in the descending order of volume, it is preferable that the above-mentioned fine grains occupy at least 50%, still preferably 70% or more, particularly preferably 85% or more, of the number of the total grains. Since a critical grain size increases with an increase of the size of the growing {100} tabular grains, it is necessary to gradually make the fine grains to be added bigger with the progress of grain growth. Further, the size of fine grains capable of disappearance varies depending on the halogen composition thereof, pH, pAg, the temperature of gelatin, the concentration of a silver halide solvent, and the like. Therefore, the critical grain size must be decided under various situations during growth. Decision of the critical grain size can be made through trial and error by repeatedly causing {100} tabular grains of known size to grow by addition of fine grains having a varied known size and a coefficient of size variation of about 0.1. While it is recommended to add a fine-grain emulsion throughout the growth step, the silver halide emulsion of the present invention includes all those in which not less than 5%, preferably not less than 10%, of the total silver content deposited by crystal growth has been gained by addition of the above-mentioned fine grains. The fine-grain emulsion may be added either continuously or intermittently. The fine-grain emulsion may be continuously prepared by feeding a silver nitrate solution and a halide solution to a mixer placed near the reaction vessel and continuously supplied to the reaction vessel. Otherwise the emulsion may be prepared batchwise in a separate container and added to the reaction vessel continuously or intermittently. The fine-grain emulsion to be added may be in the form of liquid or dry powder.

The size of the fine grains is measured by directly photographing the grains with a low-temperature transmission electron microscope (hereinafter referred to as a direct TEM method) as hereinafter described in detail. The fine grains are mostly cubic so that their volume can be obtained by a direct TEM method. In case they are not cubic particles, a proper method of measurement should be selected based on their crystal habit. It is desirable that the fine grains contain substantially no multiple twins, the term "multiple twins" meaning crystals having two or more twinning planes per grain, and the term "contain substantially no multiple twins" meaning that the proportion of multiple twins in number is not more than 5%, preferably not more than 1%, still preferably not more than 0.1%. It is more desirable for the fine grains to contain no substantial single twins. It is also desirable for them to contain no substantial screw dislocations. The above definition for the term "contain substantially no such and such" also applies with respect to "single twins" and "screw dislocations". The halogen composition of the fine grains include AgCl, AgBr, AgBrI (the iodide ion content is preferably not more than 20 mol%, still preferably not more than 10 mol%), and mixed crystals of two or more thereof.

An illustrative example of a direct TEM method is shown below.

1. Preparation of Sample

A silver halide emulsion in the course of and/or after grain formation was added to a methanolic solution of a deformation preventive compound represented by formula:

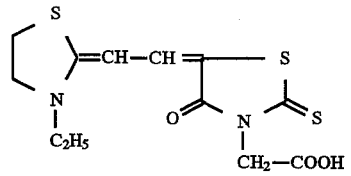

or phenylmercaptotetrazole ($1\times10^{-3}$ to $1\times10^{-2}$ mol/mol-Ag) so as to prevent the emulsion grains from being deformed. The grains were collected by centrifugal separation, dropped on a sample rack (mesh) for electron microscopic observation, on which a carbon supporting film had previously been adhered, and dried to prepare a sample.

2. Observation of Grains

The sample was observed under an electron microscope JEM-2000 FXII manufactured by JEOL Ltd. under conditions of accelerating voltage of 200 kV, magnifications of 5000 to 50000, and a temperature of −120° C. using a sample cooling holder 626-0300 Cryostation manufactured by Gatan Co.

Ripening and/or growth of silver halide grains are preferably carried out under conditions of a pCl of 1.6 or more, still preferably 1.6 to 2.5, and a temperature of 65° C. or higher, still preferably 65° to 80° C. It is preferable also for silver halide grains other than pure silver chloride grains to be formed in the above-described chloride ion concentration; for it is preferable for tabular grains to be formed under such conditions that cause formation of cubic grains and the above-described chloride ion concentration meets such conditions. The excess chloride ion may be regarded as a kind of crystal habit controlling agent.

Growth of tabular grains is characteristically carried out by adding a silver salt and a halogen salt at such feeding rates that generate new nuclei and that the newborn nuclei may not grow larger than a critical grain size. It is preferable that the number of the new nuclei present in the growth system be at least twice, still preferably 5 or more times, particularly preferably 10 or more times, the number of {100} tabular grains. Occurrence of new nuclei is advantageous in that the new nuclei prevent tabular grains from dissolving and the growing grains can maintain its anisotropy in growth. In addition, occurrence of new nuclei reduces the degree of supersaturation of the growth system, which is also effective on the grains' maintaining anisotropy in growth. Occurrence of new nuclei, the number of new nuclei, and whether or not grains larger than a critical grain size are formed can be confirmed by direct TEM observation on an emulsion sample prepared without conducting centrifugal separation. The feeding rate which would cause occurrence of new nuclei and would not allow the new nuclei to grow larger than a critical grain size varies depending on the supplied halogen composition, pH, pAg, gelatin species, gelatin concentration, temperature, the concentration of a silver halide solvent, the size of growing {100} tabular grains, and the like. Therefore, the feeding rate should be decided by trial and error through repetition of experiments under various situations of grain growth. In general, the range of the feeding rate satisfying the above conditions becomes broader as the pCl value increases. While it is desirable for new nuclei to be always born throughout the growth step, all the emulsions that are prepared in a system where new nuclei have occurred while preferably at least 5%, more preferably not less than 10%, of the total silver content deposited by crystal growth is being deposited are regarded to be included in the scope of the present invention. In these cases, too, newborn nuclei must always be present in the system while a silver salt is being added.

Tabular grain formation is characterized by using, as seed crystals, silver halide grains having a Cl content of not less than 10 mol%, inclusive of pure silver chloride grains, having a coefficient of volume variation of not more than 0.2 and an average volume of not more than 0.001 $\mu m^3$. The seed crystals preferably have a Cl content of not less than 10 mol%, still preferably not less than 30 mol%, and particularly preferably not less than 70 mol%. The volume and the coefficient of volume variation of seed crystals can be measured by a direct TEM method. The coefficient of volume variation of seed crystals is preferably not more than 0.2, still preferably not more than 0.15, and particularly preferably not more than 0.1. The volume of seed crystals is preferably not more than 0.001 $\mu m^3$, still preferably not more than 0.0005 $\mu m^3$, and particularly preferably not more than 0.0003 μm. In grain formation using ordinary silver salt and halogen salt, reproducibility and monodisperse properties of the grain formation system would be deteriorated upon increasing the scale of production. The advantage of use of monodisperse seed crystals therefore consists in ensuring reproducibility and monodisperse properties even on scaling up the production. In using seed crystals, the resulting tabular grains preferably have a coefficient of variation of not more than 0.25, still preferably not more than 0.20, and particularly preferably not more than 0.15. The term "coefficient of variation" as used with respect to the degree of monodispersion is a value obtained by dividing a variation of grain size, as expressed in terms of a projected area circle-equivalent diameter, (standard deviation) by a mean grain size. Such control of coefficient of variation of the completed grains makes it possible to provide a highly sensitive and high-contrast emulsion. A halogen gap necessary for grain formation is preferably introduced by addition of a bromide alone, simultaneous addition of a bromide and a silver salt, addition of a bromide/chloride mixture, or simultaneous addition of a bromide/chloride mixture and a silver salt. Potassium ferrocyanide is preferably used as impurity. Depending upon the surface area of the seed crystals, the optimum amounts of halogen and impurity to be added must be decided by trial and error. Should the amounts of halogen and impurity added be too small, no tabular nucleus is formed. At too large amounts, thick grains would be formed considerably.

The nucleation step and ripening step will then be described in greater detail.

(1) Nucleation

A silver salt ($Ag^+$) and a halogen salt ($X_1^-$) are reacted in a solution of a dispersing medium comprising at least water and a dispersing medium to form host silver halide nuclei $AgX_1$. Alternatively, monodisperse $AgX_1$ fine grains are used as seed crystals.

A solution of a different halogen salt ($X_2^-$) or impurity (e.g., potassium ferrocyanide) is added to substantially introduce a dislocation causing formation of tabular grains. In order to form the dislocation as desired in the present invention, the conditions of the above reaction must be so set as to provide an atmosphere for {100} face formation. Since the formation of the dislocation is very slow, it is important for the system to be left as such with no further addition for a given period of time (preferably 3 minutes or more, still preferably 7 minutes or more) after the addition of the $X_2^-$solution or impurity.

Crystal habit controlling agents which are necessary in the nucleation include the compounds disclosed in EP-A-0534395; gelatin having a high methionine content (preferably not less than 10 μmol/g, still preferably 30 to 200 μmol/g); and known water-soluble dispersing media for silver halide emulsions. As for general information about the water-soluble dispersing media for silver halide emulsions, *Research Disclosure,* Vol. 307, Item 307105 (Nov., 1989) can be referred to. The dispersing media described in JP-B-52-16365 (the term "JP-B" as used herein means an "examined published Japanese patent application"), JP-A-59-8604, and *Journal of Imaging Science,* Vol. 31, pp. 148–156 (1987) are preferred.

The nucleation temperature preferably ranges from 20° to 80° C., still preferably 25° to 50° C. The smaller the size of the nuclei, the more easily ripening proceeds. Small nuclei are also advantageous for the formation of thin grains. From this viewpoint, nucleation is preferably conducted at a low temperature. Nevertheless, energy is essentially required for forming a dislocation. Both requirements can be satisfied by conducting the formation of silver halide nuclei at a low temperature and elevating the temperature at the time of forming a dislocation by preferably at least 2° C., more preferably 5° to 30° C.

It is preferable that silver halide fine grains necessary for ripening be supplied before ripening. In order to allow the formed tabular grains to grow easily without dissolving, it is preferable to add a chloride and a silver salt. Addition of the halogen also acts to stop introduction of the dislocation which imparts anisotropic growth properties to the grains.

(2) Ripening

It is difficult to selectively form only tabular grain nuclei at the time of nucleation. Therefore, grains other than tabular grains are made to disappear in the ripening step. Ripening is usually carried out at 65° to 90° C. Through the ripening step, non-tabular grains disappear and are deposited on the tabular grains. It is preferable that fine grains of such composition and size that make them more easily soluble than the growing tabular grains be present in the initial stage of the ripening so that the tabular grains hardly disappear in the initial stage. Further, it is desirable that additional dislocations should not be introduced any more during the ripening. This can be achieved by allowing the system to stand as such for a sufficient period of time after addition of a different halogen or impurity thereby to reach equilibrium or by adding a halogen of the same composition as $AgX_1$ to minimize the influences of the different halogen and impurity.

It is preferable that physical ripening, which is usually conducted before grain growth, should not be performed to such an extent that all the fine grains disappear. If all the fine grains disappear, it follows that the corners of the tabular grains dissolve, and grains with reduced anisotropy in growth make their appearance. It is therefore preferred to initiate growth while the fine grains exist in the system.

Conditions of chemical sensitization in the present invention are not particularly limited. It is usually carried out at a pAg of 6 to 11, preferably 7 to 10, and a temperature of 40° to 95° C. preferably 45° to 85° C.

It is preferable to use a noble metal sensitizer containing gold, platinum, palladium or iridium, in chemical sensitization. Particularly preferred is a gold sensitizer, such as chloroauric acid, potassium chloroaurate, potassium aurithiocyanate, gold sulfide or gold selenide. The gold sensitizer is usually used in an amount of about $10^{-7}$ to $10^{-2}$ mol per mole of silver.

Use of a sulfur sensitizer is also preferred. Suitable sulfur sensitizes include known instable sulfur compounds, such as thiosulfates (e.g., Hypo), thioureas (e.g., diphenylthiourea, triethylurea and allylthiourea), and rhodanines. The sulfur sensitizer is usually used in an amount of about $10^{-7}$ to $10^{-2}$ mol per mole of silver.

Use of a selenium sensitizer is preferred as well. Suitable selenium sensitizes include the instable selenium compounds described in JP-B-44-15748, such as colloidal selenium, selenoureas (e.g., N,N-dimethylselenourea, selenourea, and tetramethylselenourea), selenoamides (e.g., selenoacetamideand N,N-dimethylselenobenzamide), selenoketones (e.g., selenoacetone and selenobenzophenone), selenides (e.g., triphenylphosphine selenide and diethyl selenide), selenophosphates (e.g., tri-p-tolyl selenophosphate), selenocarboxylic acids and esters thereof, and isoselenocyanates. The selenium sensitizer is usually used in an amount of about $10^{-8}$ to $10^{-3}$ mol per mole of silver.

In the present invention, tellurium sensitization in the presence of a silver halide solvent is also preferred.

Specific examples of the silver halide solvent include thiocyanates (e.g., potassium thiocyanate), thioether compounds (e.g., the compounds described in U.S. Pat. Nos. 3,021,215 and 3,271,157, JP-B-58-30571, and JP-A-60-136736, especially 3,6-dithia-1,8-octanediol), tetra-substituted thiourea compounds (e.g., the compounds described in JP-B-59-11892 and U.S. Pat. No. 4,221,863, especially tetramethylthiourea), the thione compounds described in JP-B-60-11341, the mercapto compounds described in JP-B-63-29727, the mesoion compounds described in JP-B-60-163042, the seleno-ether compounds described in U.S. Pat. No. 4,782,013, the telluro-ether compounds described in JP-A-2-118566, and sulfurous acid salts. Particularly preferred of them are thiocyanates, thioether compounds, tetra-substituted thiourea compounds, and thione compounds. These compounds are usually used in an amount of about $10^{-5}$ to $10^{-2}$ mol per mole of silver.

Examples of preferred usage and compounds useful in selenium or tellurium sensitization are given in JP-A-3-116132, JP-A-5-113635, JP-A-5-165136, JP-A-5-165137, and JP-A-5-134345. Particularly preferred selenium sensitizes include selenium compounds-I to X shown below, and particularly preferred tellurium sensitizes include tellurium compounds-I to X shown below.

Selenium Compound-I:

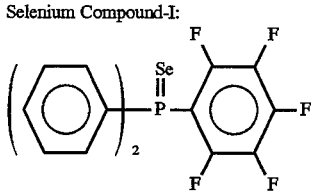

Selenium Compound-II:
KSeCN

Selenium Compound-III:

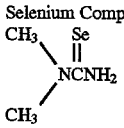

Selenium Compound-IV:

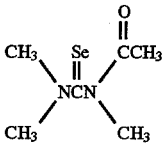

Selenium Compound-V:

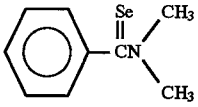

Selenium Compound-VI:

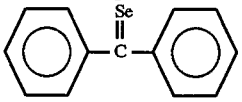

Selenium Compound-VII:

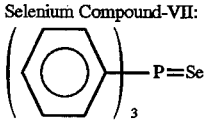

Selenium Compound-VIII:

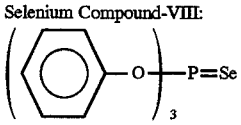

Selenium Compound-IX:

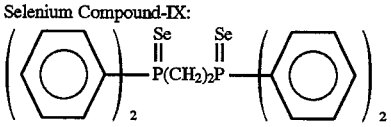

Selenium Compound-X:

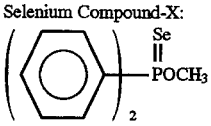

-continued

Tellurium Compound-I:

$$((i)C_3H_7)_2P\overset{\overset{\displaystyle Te}{\|}}{C}_4H_9(i)$$

Tellurium Compound-II:

$$((i)C_4H_9)_2P\overset{\overset{\displaystyle Te}{\|}}{C}_4H_9(n)$$

Tellurium Compound-III:

$$((i)C_3H_7)_2P\overset{\overset{\displaystyle Te}{\|}}{C}_4H_9(n)$$

Tellurium Compound-IV:

$$((i)C_3H_7)_3P{=}Te$$

Tellurium Compound-V:

$$(i)C_3H_7P(C_4H_9(i))_2$$

Tellurium Compound-VI:

$$C_2H_5P{\leftarrow}N(CH_3)_2)_2$$

Tellurium Compound-VII:

$$(C_2H_5)_2PN(C_2H_5)_2$$

Tellurium Compound-VIII:

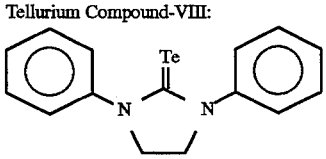

Tellurium Compound-IX:

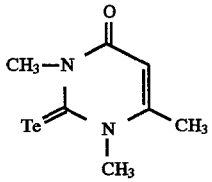

Tellurium Compound-X:

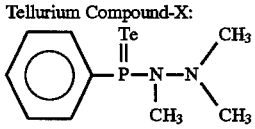

The emulsion of the present invention is preferably subjected to reduction sensitization. Reduction sensitization can be carried out by using a reducing agent, such as ascorbic acid or a derivative thereof, thiourea dioxide, stannous chloride, aminoiminomethanesulfinic acid, a hydrazine derivative, a borane compound, a silane compound, or a polyamine compound as described, e.g., JP-A-2-191938, JP-A-2-136852, and JP-B-57-33572. Reduction sensitization can be carried out by ripening while maintaining the pH of the emulsion at 7 or more or maintaining the pAg at 8.3 or less. It can also be carried out by introducing a silver ion single addition portion during grain formation.

In order to avoid influences on grain formation and crystal growth and also to conduct controlled reduction sensitization, it is preferable to conduct reduction sensitization by using a reducing agent, such as ascorbic acid or a derivative thereof or thiourea dioxide. While varying depending on the kind, the reduction sensitizer to be used preferably ranges from $10^{-7}$ to $10^{-2}$ mol per mole of silver. Reduction sensitization may be effected in any stage during grain formation and in any stage after grain formation and before chemical sensitization.

Silver halide grains can be analyzed by, for example, scanning electron microscopic analysis in which a section of a tabular grain is scanned with an electron beam to detect emission (e.g., characteristic X-rays) of the halogen atom in every part of the section, or secondary ion mass spectroscopy. For the details of these analyses, reference can be made to *Nippon Shashin Gakkaishi*, Vol. 53, pp. 125–131 (1990).

Other embodiments of doping silver halide grains with an impurity ion include an embodiment in which the whole of individual grains is doped, an embodiment in which a specific site of individual grains is doped, and an embodiment in which the surface of grains is doped to the depth within 0.1 μm. In these cases, the concentration of the doping ion is preferably $10^{-8}$ to $10^{-1}$ mol, still preferably $10^{-7}$ to $10^{-2}$ mol, per mol of silver halide.

For the details of compounds supplying impurity ions and methods for doping a silver halide phase with impurity ions, refer to *Research Disclosure,* Vol. 307, Item 307105 (Nov., 1989), U.S. Pat. Nos. 5,166,045, 4,933,272, 5,164,292, 5,132,203, 4,269,927, 4,847,191, 4,933,272, 4,981,781, and 5,024,931, JP-A-4-305644, JP-A-4-321024, JP-A-1-183647, JP-A-2-20853, JP-A-1-285941, and JP-A-3-118536.

The surface of the tabular grains of the present invention is mostly formed of {100} faces, the silver ions on the grain surface strongly attract an adsorptive group of gelatin (e.g., a methionine group), which sometimes results in hindrance to adsorption of a spectral sensitizing dye, an antifoggant and other photographic additives. This can be avoided by selecting a gelatin species having an optimum methionine content as a dispersing medium. Specifically, gelatin in a silver halide emulsion layer of a light-sensitive material preferably has an average methionine content of 0 to 50 μmol/g, still preferably 3 to 30 μmol/g. In this embodiment, the silver halide emulsion can be sensitized by using $10^{-2}$ to $10^{-8}$ mol of a chemical sensitizer per mole of silver halide and 5 to 100%, based on a saturated adsorption, of a sensitizing dye.

The resulting grains may be used as host grains, on the edges and/or corners of which are formed epitaxial grains. The resulting grains may also be used as cores to form grains having a dislocation line in the inside thereof. Additionally, the resulting grains may be used as substrates on which a silver halide layer having a different halogen composition from that of the substrate grain is built up to form any known grain structure. For the details of these embodiments, refer to JP-A-2-838, JP-A-2-146033, JP-A-1-201651, JP-A-3-121445, JP-A-64- 74540, JP-A-4-308840, JP-A-4-343348, Japanese Patent Appln. No. 140712/91. The emulsion grains of these embodiments are usually subjected to chemical sensitization. In the chemical sensitization, it is desirable that the sites of formation of sensitized specs and the number of the specs per $cm^2$ be controlled. For the details, the above-recited publications can also be referred to.

It is possible to use the silver halide emulsion prepared by the process of the present invention as blended with one or more than one of other silver halide emulsions. An optimum blending ratio is selected from the range of 1.0 to 0.01.

The support of the light-sensitive material according to the present invention is not particularly restricted. For example, polyethylene naphthalate (PEN) film is suitable.

Of PEN's, polyethylene-2,6-naphthalate is preferred. The terminology "polyethylene-2,6-naphthalate" as used in the present invention embraces polymers comprising an ethylene 2,6-naphthalenedicarboxylate unit as a substantial repeating unit, inclusive of not only homopolymers of ethylene 2,6-naphthalenedicarboxylate but copolymers with not more than 10%, preferably not more than 5%, of the number of the repeating units thereof being modified with other components, as well as mixtures with other polymers and compositions containing other components.

In general, polyethylene-2,6-naphthalate is synthesized by reacting naphthalene-2,6-dicarboxylic acid or a functional derivative thereof and ethylene glycol or a functional derivative thereof in the presence of a catalyst under appropriate reaction conditions. The terminology "polyethylene-2,6-naphthalate" as used herein additionally covers copolymers or mixed polyesters obtained by adding one or more than one third components as a modifier before completion of the polymerization. Such third components include compounds having a divalent ester-forming functional group, such as dicarboxylic acids (e.g., tartaric acid, adipic acid, phthalic acid, isophthalic acid, terephthalic acid, naphthalene-2,7-dicarboxylic acid, succinic acid, and diphenyl ether dicarboxylic acid) or lower alkyl esters thereof; hydroxycarboxylic acids (e.g., p-hydroxybenzoic acid and p-hydroxyethoxybenzoic acid) or lower alkyl esters thereof; and dihydric alcohols (e.g., propylene glycol and trimethylene glycol). Polyethylene-2,6-naphthalate or modified polymers thereof may have the hydroxyl group and/or carboxyl group at the terminal thereof blocked with a monofunctional compound, such as benzoic acid, benzoylbenzoic acid, benzyloxybenzoic acid or a methoxypolyalkylene glycol. Further, the polymers may be those modified with a very small amount of a tri- or tetrafunctional ester-forming compound, such as glycerol or pentaerythritol, within such an extent that a substantially linear copolymer may be obtained.

The silver halide emulsion according to the present invention manifests its excellent effects to the full when applied to a light-sensitive material comprising a support having on both sides thereof at least one silver halide emulsion layer. A light-sensitive material of this type exhibits not only the aforesaid effects but provides an image of high quality and high sharpness. Further, there is obtained an unexpected effect that the light-sensitive material does not contaminate a tank, a roller, etc. even when the rate of replenishment in development processing is reduced.

Chemical sensitization of the silver halide emulsion of the present invention can be performed by gold sensitization using a gold compound, a noble metal sensitization using iridium, platinum, rhodium, palladium, etc., sulfur sensitization using a sulfur-containing compound, reduction sensitization using a tin salt, a polyamine compound, etc., selenium sensitization, tellurium sensitization, or a combination of two or more thereof.

A suitable silver coverage of the light-sensitive material is 0.5 to 5 g/m$^2$, preferably 1 to 3.4 g/m$^2$, per side. For suitability to rapid processing, it is desirable for the silver coverage not to exceed 5 g/m$^2$ per side.

Various additives which can be used in the light-sensitive material of the present invention and usage thereof are not particularly limited. For example, the following publications can be referred to.

1) Silver halide emulsions and preparation thereof:

JP-A-2-68539, p. 8, right lower column (hereinafter abbreviated as RL), 1. 6 from the bottom to p. 10, right upper column (hereinafter abbreviated as RU), 1. 12; JP-A-3-24537, p. 2, RL, 1. 10 to p. 6, RU, 1. 1, ibid., p. 10, left upper column (hereinafter abbreviated as LU), 1. 16 to p. 11, left lower column (hereinafter abbreviated as LL), 1.19; JP-A-4-107442

2) Chemical sensitization:

JP-A-2-68539, p. 10, RU, 1. 13 to LU, 1. 16; Japanese Patent Appln. No. 105035/91

3) Antifoggants and stabilizers:

JP-A-2-68539, p. 10, LL, 1. 17 to p. 11, LU, 1. 7, ibid., p. 3, LL, 1. 2 to p. 4, LL.

4) Tone modifiers:

JP-A-62-276539, p. 2, LL, 1. 7 to p. 10, LL, 1. 20; JP-A-3-94249, p- 6, LL, 1. 15 to p. 11, RU, 1.19

5) Spectral sensitizing dyes:

JP-A-2-68539, p. 4, RL, 1.4 to p. 8, RL.

6) Surface active agents and antistatic agents:

JP-A-2-68539, p. 11, LU, 1. 14 to p. 12, LU, 1. 9

7) Matting agents, slip agents, and plasticizers:

JP-A-2-68539, p. 12, LU, 1.10 to RU, 1.10, ibid., p. 14, LL, 1. 10 to RL, 1. 1

8) Hydrophilic colloid:

JP-A-2-68539, p. 12, RU, 1. 11 to LL, 1. 16

9) Hardening agents:

JP-A-2-68539, p. 12, LL, 1. 17 to p. 13, RU, 1.6

10) Supports

JP-A-2-68539, p. 13, RU, 11. 7–20

11) Cross-over cutting method:

JP-A-2-264944, p. 4, RU, 1. 20 to p. 14, RU

12) Dyes and mordants:

JP-A-2-68539, p. 13, LL, 1. 1 to p. 14, LL, 1. 9; JP-A-3-24537, p. 14, LL to p. 16, RL

13) Polyhydroxybenzenes:

JP-A-3-39948, p. 11, LU to p. 12, LL; EP-A-452772

14) Layer structure:

JP-A-3-198041

15) Development processing:

JP-A-2-103037, p. 16, RU, 1. 7 to p. 19, LL, 1. 15; JP-A-2-115837, p. 3, RL, 1.5 to p. 6, RU, 1.10

The light-sensitive material of the present invention can be used for image formation in combination with fluorescent intensifying screens comprising a support having thereon a fluorescent layer comprising a binder and a fluorescent substance having the main peak at wavelengths of 400 nm or less, preferably 380 nm or less. While not limiting, the screens described in JP-A-6-11804 and WO 93/01521 which have the main emission peak at wavelengths of not more than 400 nm are useful. Screens having an emission wavelength of not more than 400 nm, particularly not more than 370 nm, are preferably used in the present invention.

Typical fluorescent substances include M' phase $YTaO_4$ alone or doped with Gd, Bi, Pb, Ce, Se, Al, Rb, Ca, Cr, Cd, Nd, etc.; LaOBr doped with Gd, Tm, Tm/Gd, Gd/Ce, or Tb; HfZr oxide alone or doped with Ge, Ti, an alkali metal, etc.; $Y_2O_3$ alone or doped with Gd or Eu; $Y_2O_2S$ doped with Gd; and various fluorescent substances activated with Gd, Tl or Ce. Preferred of them are M' phase $YTaO_4$ alone or doped with Gd or Sr, LaOBr doped with Gd, Tm, or Gd/Tm, and HfZr oxide alone or doped with Ge, Ti or an alkali metal.

The grain size of the fluorescent substance is suitably 1 to 20 μm but is subject to variation according to the desired sensitivity or for the production consideration. The fluorescent substance is preferably applied to a support in an amount of 400 to 2000 g/m$^2$ but is subject to variation depending on the desired sensitivity and image quality. A fluorescent layer formed on a support may have a grain size distribution in the thickness direction. In this case, it is known that the grain size is generally increased towards the surface of the layer. The volume content of the fluorescent substance in the coating layer is at least 40%, preferably 60% or more.

Where an X-ray photograph is taken with a fluorescent layer placed on both sides of the light-sensitive material, the amount of the coating fluorescent substance may be changed between the X-ray incidence side and the opposite side. Where a particularly high-speed system is required due to the screening by the intensifying screen on the incidence side, it is known that the amount of the fluorescent substance on the incidence side is reduced.

The support to be used in the fluorescent intensifying screen includes paper, a metal plate, and a polymer sheet. A flexible sheet such as a polyethylene terephthalate film is generally used. If desired, a reflecting agent or a light absorber may be added to the fluorescent layer or be provided as an independent layer. Useful reflecting agents include zinc oxide, titanium oxide and barium sulfate. Preferred are titanium oxide or barium sulfate; for the emission wavelength of the fluorescent substance is short. The reflecting agent may be provided not only between a support and a fluorescent layer but in the fluorescent layer. When it is incorporated into the fluorescent layer, it is preferably localized in the vicinities of the support.

If desired, fine unevenness may be given to the surface of the support, or an adhesive layer for improving adhesion to the fluorescent layer or a conductive layer may be provided on the support.

The binder which can be used in the screen includes naturally occurring high polymeric substances, such as proteins (e.g., gelatin), polysaccharides (e.g., dextran and corn starch), and gum arabic; synthetic high polymers, such as polyvinyl butyral, polyvinyl acetate, polyurethane, polyalkyl acrylate, polyvinylidene chloride, nitrocellulose, fluorine-containing polymers, and polyester; or mixtures or copolymers thereof. It is desirable for a binder to have a high transmission rate for emission from a fluorescent substance. From this viewpoint, gelatin, corn starch, acrylic polymers, fluorine-containing olefin polymers or copolymers, and styrene-acrylonitrile copolymers are preferably used as a binder. The binder may have a functional group crosslinkable with the aid of a crosslinking agent. In order to meet the image quality demand, the binder may contain a fluorescence absorber, or a binder having a low transmission may be used. The absorber includes pigments, dyes, and ultraviolet absorbers. The fluorescent substance to binder ratio usually ranges from 1:5 to 50:1, preferably from 1:1 to 5:1, by volume. The fluorescent substance to binder ratio may be uniform or nonuniform in the thickness direction.

The fluorescent layer is usually formed by coating a support with a coating composition prepared by dispersing a fluorescent substance in a binder solution. The solvent to be used for dissolving the binder includes water or organic solvents, such as alcohols, chlorinated hydrocarbons, ketones, esters, and ether aromatic compounds, or mixtures thereof.

The coating composition may contain dispersion stabilizers, such as phthalic acid, stearic acid, caproic acid, and surface active agents; and plasticizers, such as phosphoric esters, phthalic esters, glycolic esters, polyesters, and polyethylene glycol.

A protective layer may be provided on the fluorescent layer. The protective layer is usually formed by coating the fluorescent layer with a coating composition or laminating a separately prepared protective film on the fluorescent layer. When formed by coating, the protective layer may be formed either simultaneously with the fluorescent layer or after drying the fluorescent layer. The protective layer may be formed of the same binder as used in the fluorescent layer. In addition to the above-described binders, cellulose derivatives, polyvinyl chloride, melamine resins, phenolic resins, and epoxy resins may also be used as a protective layer. Preferred materials as a protective layer include gelatin, corn starch, acrylic polymers, fluorine-containing olefin polymers or copolymers, and styrene-acrylonitrile copolymers. The protective layer usually has a thickness of 1 to 20 μm, preferably 2 to 10 μm, still preferably 2 to 6 μm. It is preferable to emboss the surface of the protective layer. The protective layer may contain a matting agent or, according to the image quality demand, may contain a substance which scatters the emitted light, for example, titanium oxide.

The protective layer may also contain a slip agent. Suitable slip agents include polysiloxane skeleton-containing oligomers and perfluoroalkyl-containing oligomers.

The protective layer may be endowed with conductivity. Agents for imparting conductivity include white and transparent inorganic conductive substances and organic antistatic agents. Examples of suitable inorganic conductive substances are ZnO powder, whisker, $SnO_2$, and indium-tin oxide (ITO).

The light-sensitive material of the present invention can preferably be developed with a developing solution containing ascorbic acid or a derivative thereof (hereinafter inclusively referred to as ascorbic acid compounds) as a developing agent.

The effects of the present invention are pronouncedly exhibited at a low replenishment rate, preferably not more than 10 cc, still preferably not more than 5 cc, per JS(10×12) unit size film (10"×12").

The ascorbic acid compounds which can be used as a developing agent preferably include the compounds represented by formula (I), especially compound Nos. I-1 to I-8 and II-9 to II-12, described in JP-A-5-165161.

Generally known structures of ascorbic acid compounds useful as a developing agent include an endiol form, an enaminol form, an endiamine form, a thiol-enol form, and an enamine-thiol form. Examples of these compounds are described in U.S. Pat. No. 2,688,549 and JP-A-62-237443. Processes for synthesizing these ascorbic acid compounds are also well known as described, e.g., in Tsugio Nomura and Hirohisa Okmura, Reducton no kagaku, Uchida Rokakuho Shinsha (1969).

The ascorbic acid compounds may be used in the form of an alkali metal salt thereof, such as a lithium salt, a sodium salt, and a potassium salt. The ascorbic acid compound is preferably used in a concentration of 1 to 100 g, preferably 5 to 80 g, per liter of a developing solution.

In the present invention, the ascorbic acid developing agent is preferably combined with a 1-phenyl-3-pyrazolidone auxiliary developing agent or a p-aminophenol auxiliary developing agent.

Useful 3-pyrazolidone auxiliary developing agents include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, and 1-p-tolyl-4-methyl-4-hydroxymethyl-3-pyrazolidone.

Useful p-aminophenol auxiliary developing agents include N-methyl-p-aminophenol, p-aminophenol, N(62-hydroxyethyl)-p-aminophenol, N-(4-hydroxyphenyl) glycine, 2-methyl-p-aminophenol, and p-benzylaminophenol, with N-methyl-p-aminophenol being particularly preferred.

The auxiliary developing agents are preferably used in a concentration of 0.001 to 1.2 mol per liter of a developing solution.

Alkali agents which can be used in a developing solution for pH adjustment include sodium hydroxide, potassium hydroxide, sodium carbonate, potassium carbonate, sodium tertiary phosphate, and potassium tertiary phosphate.

Sulfites which can be used as a preservative in a developing solution include sodium sulfite, potassium sulfite, lithium sulfite, ammonium sulfite, sodium bisulfite, and potassium metabisulfite. The sulfite is preferably added to a concentration of at least 0.01 mol/1, particularly 0.02 mol/l or higher. A recommended upper limit is 2.5 mol/1.

In addition, a developing solution may further contain the additives described in L. F. A. Mason, *Photographic Processing Chemistry*, pp. 226–229, Focal Press (1966), U.S. Pat. Nos. 2,193,015 and 2,592,364, and JP-A-48-64933.

It is desirable for the ascorbic acid compound-containing developer as used in the present invention not to contain a boric acid compound (e.g., boric acid or borax) as a pH buffering agent and the like as is often added to general developing solutions.

The developing solution can be prepared in accordance with the description of JP-A-61-177132, JP-A-3-134666, and JP-A-3-67258.

The method of replenishment of a developing solution described in JP-A-5-216180 can be applied to the present invention.

Where the light-sensitive material is rapidly developed within a dry-to-dry developing time of 100 seconds or less, various manipulations can be taken in order to prevent processing unevenness incidental to rapid processing. For example, a rubber-made roller like that described in JP-A-63- 151943 can be applied as a roller provided at the outlet of a developing tank; the flow volume of a developing solution is increased to 10 m/min or more for agitation of the solution as described in JP-A-63-151944; and a developing solution is agitated more strongly at least while it is being used for development processing than when it stands by.

While the light-sensitive materials of the present invention are not particularly limited in application, they are mainly used as ordinary black-and-white light-sensitive materials, especially photographic materials suitable to a laser light source, photosensitive materials for printing, medical X-ray films for direct photographing, medical X-ray films for indirect photographing, CRT image recording light-sensitive materials, microfilms, and light-sensitive materials for general photographing. They are also useful as color negative films, color reversal films, color paper, and the like. They are further useful as heat-developable black-and-white or color light-sensitive materials.

The present invention will now be illustrated in greater detail with reference to Examples, but it should be understood that the present invention is not construed as being limited thereto. Unless otherwise indicated, all the percents used for solution concentrations are by weight.

EXAMPLE 1

Preparation of {100} Tabular Grain Emulsion 1-1

In a reaction vessel were charged 1582 ml of an aqueous gelatin solution [containing 19.5 g of deionized, alkali-processed osseous gelatin having a methione content of about 40 μmol/g (hereinafter referred to as gelatin-1) and 7.8 ml of a 1N aqueous solution of $HNO_3$ (pH: 4.3)] and 13 ml of an aqueous solution containing 10 g of NaCl per 100 ml (hereinafter referred to as NaCl-1 solution). To the gelatin solution were added simultaneously 15.6 ml of an aqueous solution containing 20 g of $AgNO_3$ per 100 ml (hereinafter referred to as Ag-1 solution) and the same volume of an aqueous solution containing 7.05 g of NaCl per 100 ml (hereinafter referred to as X-1 solution) at a rate of 62.4 ml/min while maintaining at 40° C. After stirring the mixture for 3 minutes, 28.2 ml of an aqueous solution containing 2 g of $AgNO_3$ per 100 ml (hereinafter referred to as Ag-2 solution) and the same volume of an aqueous solution containing 1.4 g of KBr per 100 ml (hereinafter referred to as X-2 solution) were simultaneously added at a rate of 80.6 ml/min. After stirring the mixture for 3 minutes, 46.8 ml of Ag-1 solution and the same volume of X-1 solution were added thereto simultaneously at a rate of 62.4 ml/min, followed by stirring for 2 minutes. To the mixture was added 203 ml of an aqueous solution containing 13 g of gelatin-1, 1.3 g of NaCl, and a 1N aqueous NaOH solution in an amount enough to adjust to pH 6.5 thereby to adjust to pCl1.8. The temperature was raised to 75° C., the pCl was adjusted to 1.8, and the system was allowed to ripen for 42 minutes. Then, an AgCl fine-grain emulsion (average grain diameter: 0.1 μm) was added thereto at an AgCl feed rate of $2.68\times10^{-2}$ mol/min over 20 minutes, followed by ripening for 10 minutes. A flocculant was added, the temperature was dropped to 35° C., and the emulsion was washed with water by a flocculation method. An aqueous gelatin solution was added, and the emulsion was adjusted to pH 6.0 at 60° C. A transmission electron micrograph (hereinafter abbreviated as TEM) of a replica of the resulting emulsion grains revealed that the grains were high-AgCl {100} tabular grains containing 0.44 mol% of AgBr based on silver. The grain shape characteristics were as follows.

(Total projected area of tabular grains having an aspect ratio of more than 2/total projected area of all grains) $\times100=a_1=90\%$ Average aspect ratio of tabular grains (average diameter/average thickness)$=a_2=9.3$ Average diameter of tabular grains$=a_3=1.67$ μm Average thickness$=a_4=0.18$ μm Coefficient of variation of $a_3=a_5=25\%$

Preparation of {100} Tabular Grain Emulsions 1-2 to 1-6

Emulsions 1-2 to 1-6 were prepared in the same manner as for emulsion 1-1, except for changing the stirring time after the simultaneous addition of Ag-2 solution and X-2 solution as shown in Table 1 below. The grain shape characteristics of the resulting emulsions were obtained in the same manner as described above. The results obtained are also shown in Table 1.

TABLE 1

| Emulsion No. | Stirring Time (min) | $a_1$ (%) | $a_2$ | $a_3$ (μm) | $a_4$ (μm) | $a_5$ (%) |
|---|---|---|---|---|---|---|
| 1-1 | 3 | 90 | 9.3 | 1.67 | 0.18 | 25 |
| 1-2 | 10/60 | 92 | 12.3 | 1.9 | 0.154 | 25 |
| 1-3 | 2 | 90 | 10.0 | 1.73 | 0.173 | 26 |
| 1-4 | 8 | 86 | 8.1 | 1.56 | 0.192 | 27 |
| 1-5 | 12 | 78 | 6.2 | 1.36 | 0.22 | 28 |
| 1-6 | 20 | 70 | 5.1 | 1.24 | 0.24 | 29 |

It is seen that tabular grain emulsions having a high aspect ratio can be obtained by setting the time after formation of a halogen gap (i.e., after addition of Ag-2 solution and X-2 solution) up to next addition of Ag-1 solution within 10 minutes.

EXAMPLE 2

Emulsions 2-1 to 2-6 were prepared in the same manner as for emulsion 1-1 of Example 1 except for changing the amounts of Ag-1 solution and X-1 solution to be added after the addition of Ag-2 solution and X-2 solution as shown in Table 2. The time required for addition was made equal by adjusting the feeding rate. The grain shape characteristics of the resulting emulsions are shown in Table 3.

TABLE 2

| Emulsion No. | Amount of Ag-1 Solution (ml) | Amount of X-1 Solution (ml) | Amount of Ag Added (mol %) |
|---|---|---|---|
| 2-1 | — | — | 0 |
| 2-2 | 46.8 | — | 9 |
| 2-3 | 15.6 | 15.6 | 3 |
| 2-4 | 7.8 | 7.8 | 1.5 |
| 2-5 | 2.6 | 2.6 | 0.5 |
| 2-6 | 31.2 | 15.6 | 6 |
| 1-1 | 46.8 | 46.8 | 9 |

TABLE 3

| Emulsion No. | $a_1$ (%) | $a_2$ | Remark |
|---|---|---|---|
| 1-1 | 90 | 9.3 | Invention |
| 2-1 | 30 | 1.3 | Comparison |
| 2-2 | 92 | 10.8 | Invention |
| 2-3 | 90 | 8.4 | " |
| 2-4 | 86 | 7.0 | " |
| 2-5 | 40 | 1.6 | Comparison |
| 2-6 | 87 | 8.8 | Invention |

As is apparent from Table 3, {100 } tabular grain emulsions having a high aspect ratio can be obtained by adding 1 mol% or more, based on the final silver content, of silver ions after halogen gap introduction.

EXAMPLE 3

Emulsions 3-1 to 3-4 were prepared in the same manner as for emulsion 1-1 of Example 1 except that the temperature rise after nucleation from 40° C. to 75° C. (temperature difference ΔT: 35° C.) was changed as shown in Table 4 below. The grain shape characteristics of the resulting emulsion are also shown in Table 4.

TABLE 4

| Emulsion No. | Temperature After Rise (°C.) | ΔT (°C.) | $a_1$ (%) | $a_2$ |
|---|---|---|---|---|
| 1-1 | 75 | 35 | 90 | 9.3 |
| 3-1 | 65 | 25 | 85 | 8.1 |
| 3-2 | 85 | 45 | 92 | 11.0 |
| 3-3 | 55 | 15 | 80 | 5.3 |
| 3-4 | 50 | 10 | 72 | 4.4 |

It is apparently seen from Table 4 that the aspect ratio is significantly increased where the temperature of the grain growth system is higher than that of the nucleation system by 20° C. or more.

EXAMPLE 4

Emulsions 4-1 to 4-5 were prepared in the same manner as for emulsion 1-1 of Example 1, except for changing, as shown in Table 5, the coefficient of variation of sphere-equivalent diameter of the AgCl fine-grain emulsion added in the growth stage after 20 minutes' ripening. The average sphere-equivalent diameter (average grain size) was about 0.1 μm in each case.

Further, emulsions 4-6 to 4-10 were prepared in the same manner for emulsion 2-1 of Example 2 except for changing the coefficient of variation of sphere-equivalent diameter of AgCl fine-grain emulsion added in the growth stage as shown in Table 5. The average sphere-equivalent diameter (average grain size) was about 0.1 μm in each case.

The grain shape characteristics of the resulting emulsion as obtained in the same manner as in Example 1 are also shown in Table 5. As is seen from these results, according as the coefficient of variation of an average sphere-equivalent diameter of the fine-grain emulsion added is made smaller, the finally obtained {100} tabular grains have a higher aspect ratio and a higher degree of monodispersion.

TABLE 5

| Emulsion No. | C.V.* of Fine Grains (%) | $a_1$ (%) | $a_2$ | $a_5$ (%) | Remark |
|---|---|---|---|---|---|
| 1-1 | 18 | 90 | 9.3 | 25 | Comparison |
| 4-1 | 22 | 88 | 7.1 | 31 | " |
| 4-2 | 17 | 88 | 7.5 | 29 | " |
| 4-3 | 13 | 90 | 10.1 | 24 | Invention |
| 4-4 | 8 | 92 | 11.0 | 21 | " |
| 4-5 | 4 | 93 | 12.1 | 19 | " |
| 4-6 | 22 | 20 | 1.2 | 30 | Comparison |
| 4-7 | 17 | 40 | 1.8 | 28 | " |
| 4-8 | 13 | 45 | 3.0 | 26 | Invention |
| 4-9 | 8 | 51 | 3.7 | 24 | " |
| 4-10 | 4 | 60 | 5.0 | 22 | " |

Note: C.V. = Coefficient of variation

EXAMPLE 5

1) Chemical Sensitization of Silver Halide Emulsion:

Each of the emulsions according to the present invention prepared in Examples 1 to 4 was subjected to chemical sensitization while keeping at 60° C. with stirring.

To each emulsion were added successively $10^{-4}$ mol of thiosulfonic acid compound-I shown below per mole of silver halide, 1.0 mol%, based on the total silver content, of AgBr fine grains having a diameter of 0.10 μm, and $1\times10^{-6}$ mol/mol-Ag of thiourea dioxide in this order. After the addition, the system was maintained under the above conditions for 22 minutes to accomplish reduction sensitization. Then, $3\times10^{-4}$mol/mol-Ag of 4-hydroxy-6-methyl-1,3,3*a*,7-tetraazaindene, $1\times10^{-3}$ mol/mol-Ag of sensitizing dye-1 shown below, and $1\times10^{-5}$ mol/mol-Ag of sensitizing dye-2 shown below were added. Calcium chloride was added. Subsequently, $6\times10^{-6}$ mol/mol-Ag of sodium thiosulfate, $4\times10^{-6}$ mol/mol-Ag of selenium compound-I shown above, $1\times10^{-5}$ mol/mol-Ag of chloroauric acid, and $3.0\times10^{-3}$ mol/mol-Ag of potassium thiocyanide were added. Forty minutes later, the emulsion was cooled to 35° C. to obtain a finished emulsion.

Thiosulfonic acid compound-I:
$C_2H_5SO_2SNa$

Sensitizing dye-1:

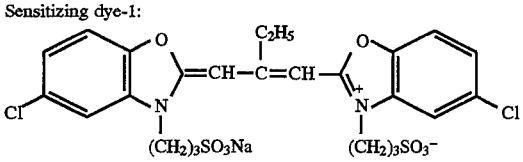

Sensitizing dye-2:

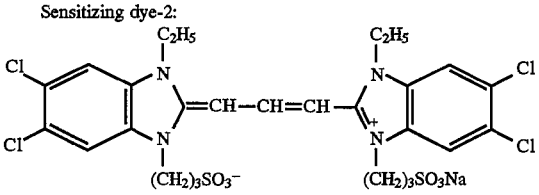

2) Preparation of Light-sensitive Coating Composition:

To the chemically sensitized emulsion were added the following chemicals in the amount shown per mole of silver halide to prepare a set of two coating compositions for every emulsion.

| | |
|---|---|
| Gelatin | 111 g* |
| Dextran (avg. mol. wt.: 39,000) | 21.5 g |
| Sodium polyacrylate (avg. mol. wt.: 400,000) | 5.1 g |
| Sodium polystyrenesulfonate (avg. mol. wt.: 600,000) | 1.2 g |
| Hardening agent (1,2-bis(vinylsulfonylacetamido)ethane) | ** |
| Compound-I | 42.1 mg |
| Compound-II | 10.3 g |
| Compound-III | 0.11 g |
| Compound-IV | 8.5 mg |
| Compound-V | 0.43 g |
| Compound-VI | 0.004 g |
| Compound-VII | 0.1 g |
| Compound-VIII | 0.1 g |
| NaOH | to adjust to pH 6.1 |

*inclusive of the gelatin of the emulsion
**adjusted so that the coated layer might have a rate of swelling of 230%

Compound-I:

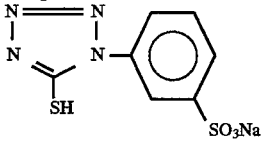

Compound-II:

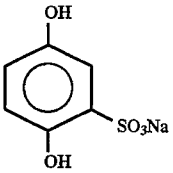

Compound-III:

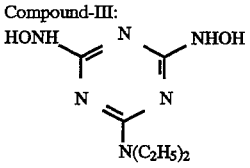

-continued

Compound-IV:

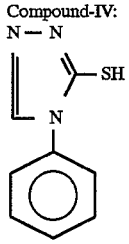

Compound-V:

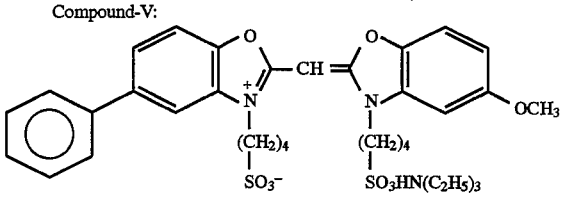

Compound-VI:

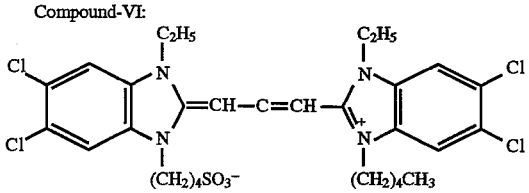

Compound-VII:

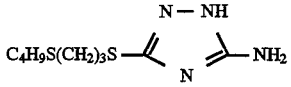

Compound-VIII:

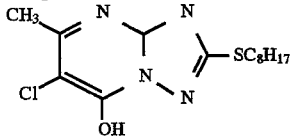

Dye emulsion A described below was added to one of the coating compositions for each emulsion in such an amount that each of ultraviolet absorbing dyes-I to III shown below would be applied to each side of a light-sensitive material to a thickness of 10 mg/m$^2$. Dye emulsion A was not added to the other coating composition for each emulsion.

Dye-I:

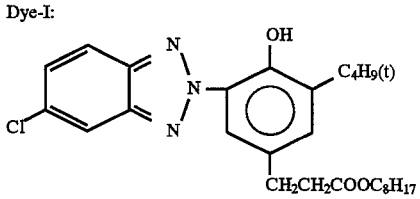

Dye-II:

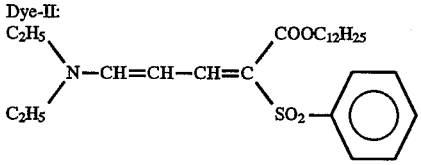

Dye-III:

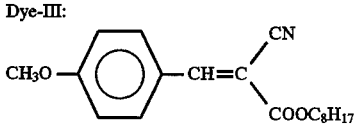

3) Preparation of Dye Emulsion A:

Twenty grams each of dye-1 to III, 62.8 g each of high-boiling organic solvent-I and II shown below, and 333 g of ethyl acetate were mixed and dissolved. To the resulting solution were added 65 cc of a 5% aqueous solution of sodium dodecylsulfonate, 94 g of gelatin, and 581 cc of water, and the mixture was dispersed and emulsified at 60° C. for 30 minutes in a dissolver. To the emulsion were added 2 g of compound-IX shown below and 6 l of water, and the emulsion was heated to 40° C. The emulsion was concentrated to a weight of 2 kg by use of an ultrafiltration membrane, Labomodule ACP1050 produced by Asahi Chemical Industry Co., Ltd. Finally, 1 g of compound-IX was added thereto to prepare dye emulsion A.

High-Boiling Organic Solvent-I:

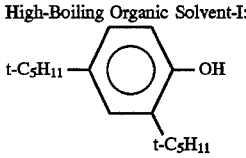

High-Boiling Organic Solvent-II:

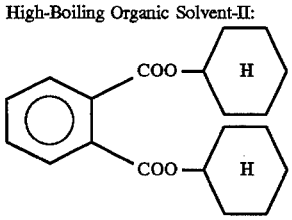

Compound-IX:

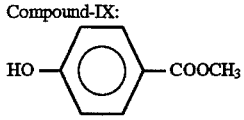

4) Preparation of Coating Composition for Surface Protective Layer:

A coating composition for a surface protective layer was prepared from the following components. The amount shown for each component is a coating weight per $m^2$.

| | |
|---|---|
| Gelatin | 0.780 g |
| Sodium polyacrylate (avg. mol. wt.: 400,000) | 0.035 g |
| Sodium polystyrenesulfonate (avg. mol. wt.: 600,000) | 0.0012 g |
| Polymethyl methacrylate (grain size: 3.7 μm | 0.072 g |
| Coating aid-I | 0.020 g |
| Coating aid-II | 0.037 g |
| Coating aid-III | 0.0080 g |
| Coating aid-IV | 0.0032 g |
| Coating aid-V | 0.0025 g |
| Compound-X | 0.0022 g |
| Proxel | 0.0010 g |
| NaOH | to adjust to pH 6.8 |

Coating Aid-I:

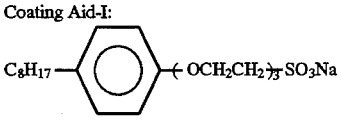

Coating Aid-II:

$C_{18}H_{33}O(CH_2CH_2O)_{10}H$

-continued

Coating Aid-III:

$C_{17}H_{33}CON(CH_3)CH_2CH_2SO_3Na$

Coating Aid-IV:

$C_8F_{17}SO_2N(C_3H_7)(CH_2CH_2O)_{15}H$

Coating Aid-V:

$C_8F_{17}SO_2N(C_3H_7)(CH_2CH_2O)_4(CH_2)_4SO_3Na$

Compound-X:

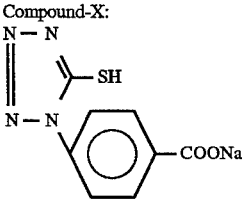

5) Preparation of Support A:

A 175 μm thick biaxially stretched polyethylene terephthalate film (containing 0.06% of dye-IV and 0.06% of dye-V, both shown below) was subjected to corona discharge. A primer coating composition having the following composition was applied to each side of the film by means of a wire bar coater at a spread of 4.9 cc/$m^2$ and dried at 185° C. for 1 minute.

Dye-IV:

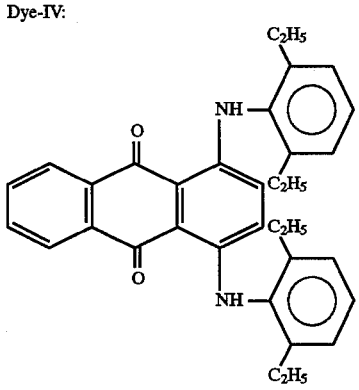

Dye-V:

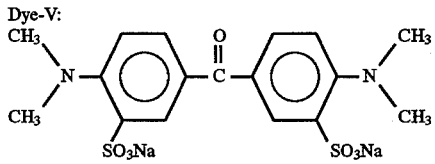

Primer Coating Composition:

| | |
|---|---|
| Butadiene-styrene copolymer latex solution* (solid content: 40%; butadiene/styrene weight ratio = 31/69) | 158 cc |
| 2,4-Dichloro-6-hydroxy-s-triazine sodium salt (4% solution) | 41 cc |
| Distill water | 801 cc |

*Containing the following compound as a dispersant in an amount of 0.4% based on the solid content.

Dispersant:

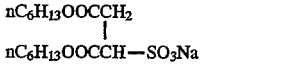

6) Preparation of Support B:

Support B was prepared in the same manner as for support A, except that dye-V was not used.

7) Preparation of Light-Sensitive Material:

The light-sensitive coating composition and the coating composition for a surface protective layer were applied to each side of support A or B by co-extrusion coating at a single spread of 1.75 g/m$^2$.

8) Evaluation:

Ultravision First Detail (UV Screen) produced by E.I. Du Pont and GRENEX Ortho Screen HR-4 produced by Fuji Photo Film Co., Ltd. were set in contact with each side of the light-sensitive material, and both sides of the light-sensitive material were exposed for 0.05 second for X-ray sensitometry. The exposure was adjusted by changing the distance between an X-ray tube and a cassette. The exposed material was developed with a developer and a fixer by means of an automatic developing machine CEPROS-30 manufactured by Fuji Photo Film Co., Ltd.

Stock processing solutions were prepared from the following components.

| Stock Developer: | |
|---|---|
| Part A: | |
| Potassium hydroxide | 330 g |
| Potassium sulfite | 630 g |
| Sodium sulfite | 255 g |
| Potassium carbonate | 90 g |
| Boric acid | 45 g |
| Diethylene glycol | 180 g |
| Diethylenetriaminepentaacetic acid | 30 g |
| 1-(N,N-Diethylamine)ethyl-5-mercaptotetrazole | 0.75 g |
| Hydroquinone | 450 g |
| 4-Hydroxymethyl-4-methyl-1-phenyl-3-pyrazolidone | 60 g |
| Water | to make 4125 ml |
| Part B: | |
| Diethylene glycol | 525 g |
| 3,3'-Dithiobishydrocinnamic acid | 3 g |
| Glacial acetic acid | 102.6 g |
| 2-Nitroindazole | 3.75 g |
| 1-Phenyl-3-pyrazolidone | 34.5 g |
| Water | to make 750 ml |
| Part C: | |
| Glutaraldehyde (50% solution) | 150 g |
| Potassium bromide | 15 g |
| Potassium metabisulfite | 105 g |
| Water | to make 750 ml |

| Stock Fixer: | |
|---|---|
| Ammonium thiosulfate (70 wt/v %) | 3000 ml |
| Disodium ethylenediaminetetraacetate dihydrate | 0.45 g |
| Sodium sulfite | 225 g |
| Boric acid | 60 g |
| 1-(N,N-Diethylamine)-ethyl-5-mercaptotetrazole | 15 g |
| Tartaric acid | 48 g |
| Glacial acetic acid | 675 g |

-continued

| Stock Fixer: | |
|---|---|
| Sodium hydroxide | 225 g |
| Sulfuric acid (36N) | 58.5 g |
| Aluminum sulfate | 150 g |
| Water | to make 6000 ml |
| | pH = 4.68 |

The stock developer was packed in a container composed of three packs for parts A, B and C, respectively, which were connected into one body.

The stock fixer was put in a separate container of the same type.

To begin with, 300 ml of an aqueous solution containing 54 g of acetic acid and 55.5 g of potassium bromide was put as a starter in a developing tank.

The container containing the stock solution was fitted upside down to a stock tank provided on the side of an automatic developing machine, whereby the piercing blade pierced the sealing film of the pack to fill the stock tank with the stock solution.

Each of the stock developer and the stock fixer in the respective stock tank was diluted with water at the following ratio and charged into a developing tank and a fixing tank by means of a separate pump. The tanks were replenished with the processing solutions (similarly diluted with water) for every processing throughput corresponding to 8 films of JS(10×12) unit size (10"×12").

| Developer: | |
|---|---|
| Part A | 51 ml |
| Part B | 10 ml |
| Part C | 10 ml |
| Water | 125 ml |
| pH | 10.50 |

| Fixer: | |
|---|---|
| Stock fixer | 80 ml |
| Water | 120 ml |
| pH | 4.62 |

A washing tank was filled with tap water.

Three polyethylene bottles were each filled with 0.4 g of a fur preventive comprising perlite having an average grain size of 100 μm and an average pore size of 3 μm having supported thereon actinomycetes, and the opening of the bottle was covered with 300 mesh nylon cloth, through which water and the bacteria might pass. Two of them were sunk in the washing tank, and one in the stock tank (0.2 l) of washing water.

| Processing Speed and Temperature: | | |
|---|---|---|
| Development | 35° C. | 8.8 sec |
| Fixing | 32° C. | 7.7 sec |
| Washing | 17° C. | 3.8 sec |
| Squeegeeing | | 4.4 sec |
| Drying | 58° C. | 5.3 sec |
| Total | | 30 sec |
| Replenishment rate: | | |
| Developer | 25 ml/10" × 12" | |
| Fixer | 25 ml/10" × 12" | |

The results of sensitometry revealed satisfactory performance of the light-sensitive materials according to the present invention.

EXAMPLE 6

The light-sensitive materials prepared in Example 5 were automatically developed with the following developer using an automatic developing machine Fuji X-Ray Processor CEPROS-30 manufactured by Fuji Photo Film Co., Ltd. The total processing time was set at 30 seconds, and the drying air output temperature was set at 55° C.

| Stock Developer: | |
|---|---|
| Part A: | |
| Potassium hydroxide | 18.0 g |
| Potassium sulfite | 30.0 g |
| Sodium carbonate | 30.0 g |
| Diethylene glycol | 10.0 g |
| Diethylenetriaminepentaacetic acid | 2.0 g |
| 1-(N,N-diethylamino)ethyl-5-mercaptotetrazole | 0.1 g |
| L-Ascorbic acid | 43.2 g |
| 4-Hydroxymethyl-4-methyl-1-phenyl-3-pyrazolidone | 2.0 g |
| Water | to make 300 ml |
| Part B: | |
| Triethylene glycol | 45.0 g |
| 3,3'-Dithiobishydrocinnamic acid | 0.2 g |
| Glacial acetic acid | 5.0 g |
| 5-Nitroindazole | 0.3 g |
| 1-Phenyl-3-pyrazolidone | 3.5 g |
| Water | to make 60 ml |
| Part C: | |
| Glutaraldehyde (50% solution) | 10.0 g |
| Potassium bromide | 4.0 g |
| Potassium metabisulfite | 10.0 g |
| Water | to make 50 ml |

A developer was prepared by diluting 300 ml of part A, 60 ml of part B, and 50 ml of part C with water to make 1 liter and adjusting to pH 10.90.

Acetic acid was added to the above-described developer to adjust to pH 10.20 to prepare a development starter.

A fixer CE-F1 produced by Fuji Photo Film Co., Ltd. was used.

Developing temperature: 35° C.

Fixing temperature: 35° C.

Drying temperature: 55° C.

Replenishment rate:

Developer: 25 ml/10"×12" (325 ml/m$^2$)

Fixer: 25 ml/10"×12" (325 ml/m$^2$)

600 films of 10"×12" size per sample were continuously processed to obtain satisfactory performance.

It was proved that the light-sensitive material of the present invention, when combined with the above-described developer, undergo no sensitivity change throughout the above-described running test.

EXAMPLE 7

Preparation of Emulsion A:

In a reaction vessel were charged 1582 ml of an aqueous gelatin solution (containing 19.5 g of gelatin-1 and 7.8 ml of a 1N aqueous solution of $HNO_3$ (pH: 4.3)) and 13 ml of NaCl-1 solution. To the gelatin solution were added simultaneously 15.6 ml of Ag-1 solution and the same volume of X-1 solution at a rate of 62.4 ml/min while maintaining at 40° C. After stirring the mixture for 3 minutes, 28.2 ml of Ag-2 solution and the same volume of X-2 solution were simultaneously added at a rate of 80.6 ml/min. After stirring the mixture for 3 minutes, 46.8 ml of Ag-1 solution and the same volume of X-1 solution were added thereto simultaneously at a rate of 62.4 ml/min, followed by stirring for 2 minutes. To the mixture was added 203 ml of an aqueous solution containing 13 g of gelatin-1, 1.3 g of NaCl, and a 1N aqueous NaOH solution in an amount enough to adjust to pH 6.5 thereby to adjust to pCl 1.75. The temperature was raised to 75° C., the pCl was adjusted to 1.65, and the system was allowed to ripe for 3 minutes. Then, an AgCl fine-grain emulsion (hereinafter referred to as emulsion E-1) was added thereto at an AgCl feed rate of $2.68\times10^{-2}$ mol/min over 20 minutes, followed by ripening for 40 minutes. A flocculant was added, the temperature was dropped to 35° C., and the emulsion was washed with water by a flocculation method. An aqueous gelatin solution was added, and the emulsion was adjusted to pH 6.0 at 60° C. The TEM of a replica of the resulting emulsion grains revealed that the grains were {100} tabular grains containing 0.44 mol% of AgBr based on silver. The grain shape characteristics of emulsion A were as follows.

(Total projected area of {100} tabular grains having an aspect ratio of not less than 2/total projected area of all grains)×100=$a_1$=91%

Average aspect ratio of {100} tabular grains having an aspect ratio of not less than 2=$a_2'$=12.1

Average diameter of {100} tabular grains having an aspect ratio of not less than 2=$a_3'$=1.33 μm Average thickness=$a_4$=0.11 μm Length ratio of adjoining sides of major face of {100} tabular grains having an aspect ratio of not less than 2=$a_6$=1.45

Coefficient of variation of circle-equivalent diameter of the above grains (standard deviation/mean size)=$a_7$=0.13

Under the above-described reaction conditions, the critical grain size was 0.0034 μm$^3$ at the start of addition of emulsion E-1 and 0.0058 μm$^3$ at the end of the addition. Accordingly, the grain size of emulsion E-1 to be added was gradually increased in such a manner that emulsion E-1 might always contain fine grains whose size fell within 70 to 100% of the critical grain size (the maximum volume of grains capable of disappearing by the time of completion of grain formation) in a proportion of not less than 50% in number.

Preparation of Emulsion B:

Emulsion B was prepared in the same manner as for emulsion A, except that the emulsion E-1 added always contained grains whose size fell within 70 to 100% of the critical grain size in a proportion of not less than 70% in number. Since the growing grains in this system exhibited higher anisotropy than those in the emulsion A system, the critical grain size at the end of addition of emulsion E-1 was 0.0063 μm$^3$. The grain shape characteristics of emulsion B are shown below.

$a_1$=91%

$a_2'$=13.9

$a_3'$=1.39 μm $a_4$=0.10 μm $a_6$=1.35

$a_7$=0.13

Preparation of Emulsion C:

Emulsion C was prepared in the same manner as for emulsion A except that emulsion E-1 added always contained grains whose size was less than 70% of the critical grain size in a proportion of not less than 50% in number. Since the growing grains in this system exhibited lower anisotropy than those in the emulsion A system, the critical grain size at the end of addition of emulsion E-1 was 0.0054 $\mu m^3$. The grain shape characteristics of emulsion C are shown below.

$a_1$=91%

$a_2'$=9.4

$a_3'$=1.22 μm $a_4$=0.13 μm $a_6$=1.43

$a_7$=0.13

Preparation of Emulsion D:

Emulsion D was prepared in the same manner as for emulsion A, except that addition of AgCl fine-grain emulsion E-1 was replaced by C.D.J. addition (controlled double jet) of an aqueous solution containing 50 g of $AgNO_3$ per 100 ml (hereinafter referred to as Ag-3 solution) and an aqueous solution containing 17.6 g of NaCl per 100 ml (hereinafter referred to as X-3 solution) at a constant feed rate until the amount of Ag-3 solution added reached 182 ml taking an addition time of 10 minutes. As a result of TEM observation of the replica of the emulsion grains, the grains were silver chloride {100} tabular grains containing 0.44 mol% of AgBr based on silver. The grain shape characteristics of emulsion D were as follows.

$a_1$=91%

$a_2'$=9.1

$a_3'$=1.36 μm $a_4$=0.15 μm $a_6$=1.64

$a_7$=0.15

Observation of the growing grains in the growth system lent confirmation to constant existence of new nuclei.

Preparation of Emulsion E:

Emulsion E was prepared in the same manner as for emulsion D, except that Ag-3 solution and X-3 solution were added by C.D.J. over a period of 60 minutes until 182 ml of Ag-3 solution was added. The grain shape characteristics of comparative emulsion E were as follows.

$a_1$=89%

$a_2'$=5.9

$a_3'$=1.18 μm $a_4$=0.20 μm $a_6$=1.64

$a_7$=0.16

Observation of the growing grains in the growth system revealed that no new nuclei was formed at any time during the growth.

Preparation of Emulsion F:

In a reaction vessel were charged 42.7 l of an aqueous gelatin solution (containing 526.5 g of gelatin-1 and 210.6 ml of a 1N aqueous solution of $HNO_3$ (pH: 4.3)) and 351 ml of NaCl-1 solution. While the gelatin solution was maintained at 40° C., 0.5 Ag mol of an AgCl seed crystal emulsion (average grain volume: 0.0003 $\mu m^3$; coefficient of variation: 0.10) was added, followed by stirring for 3 minutes, and 761 ml of Ag-2 solution and the same volume of X-2 solution were simultaneously added thereto at a rate of 2.18 l/min. After stirring the mixture for 3 minutes, 1.26 l of Ag-1 solution and the same volume of X-1 solution were simultaneously added at a rate of 1.68 l/min. After stirring for 2 minutes, 5.48 l of an aqueous gelatin solution containing 351 g of gelatin-1, 35.1 g of NaCl, and a 1N aqueous NaOH solution in an amount enough to adjust to pH 6.5 was added thereby to adjust to pCl1.75. The temperature was raised to 75° C. the pCl was adjusted to 1.65, and the system was allowed to ripe for 3 minutes. Then, an AgCl fine-grain emulsion E-1 was added thereto at an AgCl feed rate of $7.24\times10^{-1}$ mol/min over 20 minutes, followed by ripening for 40 minutes. A flocculant was added, the temperature was dropped to 35° C., and the emulsion was washed with water by a flocculation method. An aqueous gelatin solution was added, and the emulsion was adjusted to pH 6.0 at 60° C. The TEM of a replica of the resulting emulsion grains revealed that the grains were silver chloride {100} tabular grains containing 0.44 mol% of AgBr based on silver. The grain shape characteristics of emulsion F were as follows.

$a_1$=91%

$a_2'$=8.4

$a_3'$=1.17 μm $a_4$=0.14 μm $a_6$=1.15

$a_7$=0.12

The emulsion E-1 added here always contained fine grains whose size was less than 70% of the critical grain size in a proportion of not less than 50% in number. The critical grain size was 0.0071 $\mu m^3$ at the start of addition of emulsion E-1 and 0.008 $\mu m^3$ at the end of the addition.

Preparation of Emulsion G:

Emulsion G was prepared in the same manner as for emulsion F, except for replacing the addition of the seed crystal emulsion with simultaneous addition of 421 ml of Ag-1 solution and the same amount of X-1 solution at a rate of 1.68 l/min. The grain shape characteristics of emulsion G were as follows.

$a_1$=91%

$a_2'$=8.3

$a_3'$=1.13 μm $a_4$=0.15 μm $a_6$=1.15

$a_7$=0.38

Chemical Sensitization:

Each of emulsions A to G prepared above was subjected to chemical sensitization while keeping at 60° C. with stirring.

To each emulsion were added successively $10^{-4}$ mol of thiosulfonic acid compound-I per mole of silver halide and $1\times10^{-6}$ mol/mol-Ag of thiourea dioxide. After the addition, the system was maintained under the above conditions for 22 minutes to accomplish reduction sensitization. Then, $3\times10^{-4}$ mol/mol-Ag of 4-hydroxy-6-methyl-1,3,3*a*,7-tetraazaindene, $1\times10^{-3}$ mol/mol-Ag of sensitizing dye-1, and $1\times10^{-5}$ mol/mol-Ag of sensitizing dye-2 were added. Calcium chloride was added. Subsequently, $6\times10^{-6}$ mol/mol-Ag of sodium thiosulfate, $4\times10^{-6}$ mol/mol-Ag of selenium compound-I, $1\times10^{-5}$ mol/mol-Ag of chloroauric acid, and $1\times10^{-3}$ mol/mol-Ag of potassium thiocyanide were added. Forty minutes later, the emulsion was cooled to 35° C. to obtain a finished emulsion.

Preparation of Light-sensitive Coating Composition:

To the chemically sensitized emulsion were added the following chemicals in the amount shown per mole of silver halide to prepare a coating composition.

| | |
|---|---|
| Gelatin | 111 g* |
| Dextran (avg. mol. wt.: 39,000) | 21.5 g |
| Sodium polyacrylate (avg. mol. wt.: 400,000) | 5.1 g |
| Sodium polystyrenesulfonate (avg. mol. wt.: 600,000) | 1.2 g |
| Hardening agent (1,2-bis(vinylsulfonyl-acetamido)ethane) | ** |
| Compound-I | 42.1 mg |
| Compound-II | 10.3 g |
| Compound-III | 0.11 g |
| Compound-IV | 8.5 mg |
| Compound-V | 0.43 g |
| Compound-VI | 0.004 g |
| Compound-VII | 0.1 g |
| Compound-VIII | 0.1 g |
| NaOH | to adjust to pH 6.1 |

*inclusive of the gelatin of the emulsion
**adjusted so that the coated layer might have a rate of swelling of 230%

Dye emulsion A described below was added to the coating composition in such an amount that 10 mg/m$^2$ of dye-IV would be applied to each side of a light-sensitive material.

Preparation of Dye Emulsion A:

Sixty grams of dye-IV, 62.8 g of high-boiling organic solvent-I, 62.8 g of high-boiling organic solvent-II, and 333 g of ethyl acetate were mixed and dissolved. To the resulting solution were added 65 cc of a 5% aqueous solution of sodium dodecylsulfonate, 94 g of gelatin, and 581 cc of water, and the mixture was dispersed and emulsified at 60° C. for 30 minutes in a dissolver. To the emulsion were added 2 g of compound-IX and 6 l of water, and the emulsion was heated to 40° C. The emulsion was concentrated to a weight of 2 kg by use of an ultrafiltration membrane, Labomodule ACP1050 produced by Asahi Chemical Industry Co., Ltd. Finally, 1 g of compound-IX was further added thereto to prepare dye emulsion A.

Preparation of Coating Composition for Surface Protective Layer:

A coating composition for a surface protective layer was prepared from the following components. The amount shown for each component is a coating weight per m$^2$.

| | |
|---|---|
| Gelatin | 0.780 g |
| Sodium polyacrylate (avg. mol. wt.: 400,000) | 0.035 g |
| Sodium polystyrenesulfonate (avg. mol. wt.: 600,000) | 0.0012 g |
| Polymethyl methacrylate (grain size: 3.7 μm) | 0.072 g |
| Coating aid-I | 0.020 g |
| Coating aid-II | 0.037 g |
| Coating aid-III | 0.0080 g |
| Coating aid-IV | 0.0032 g |
| Coating aid-V | 0.0025 g |
| Compound-X | 0.0022 g |
| Proxel | 0.0010 g |
| NaOH | to adjust to pH 6.8 |

Preparation of Support C:

Support C was prepared as follows.

Preparation of Dye Dispersion B (for subbing layer):

Dye-VI shown below was dispersed in a ball mill in accordance with the method described in JP-A-63-197943.

Dye-VI:

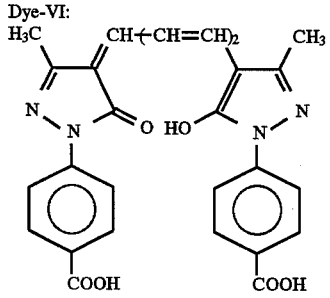

In a 2 l-volume ball mill were put 434 cc of water and 791 cc of a 6.7% aqueous solution of a surface active agent Triton X200, and 20 g of dye-VI was added thereto. To the solution was added 400 ml of zirconium oxide ($ZrO_2$) beads having a diameter of 2 mm, and the contents were ground for 4 days. Thereafter, 160 g of a 12.5% gelatin solution was added, followed by degassing and filtration to remove the $ZrO_2$ beads. The resulting dye dispersion had a dispersed grain size broadly ranging from 0.05 to 1.15 μm and an average grain size of 0.37 μm. The dye dispersion was subjected to centrifugation to remove coarse grains greater than 0.9 μm to prepare dye dispersion B.

A 175 μm thick biaxially stretched polyethylene terephthalate film (containing 0.04% of dye-IV) was subjected to corona discharge. A first primer coating composition having the following composition was applied to each side of the film by means of a wire bar coater at a single spread of 4.9 cc/m$^2$ and dried at 185° C. for 1 minute to form a first subbing layer.

First Primer Coating Composition:

| | |
|---|---|
| Butadiene-styrene copolymer latex solution* (solid content: 40%; butadiene/styrene weight ratio = 31/69) | 158 cc |
| 2,4-Dichloro-6-hydroxy-s-triazine sodium salt (4% solution) | 41 cc |
| Distill water | 801 cc |

*Containing the following compound as a dispersant in an amount of 0.4% based on the solid content.

Dispersant:

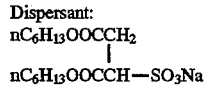

A second primer coating composition having the following composition was applied to the first subbing layer on each side of the film to give the coating weight shown (mg/m$^2$) by means of a wire bar coater and dried at 155° C. to form a second subbing layer.

Second Primer Coating Composition:

| | |
|---|---|
| Gelatin | 80 mg/m$^2$ |
| Dye dispersion B (as dye solid content) | 8 mg/m$^2$ |

-continued

| | |
|---|---|
| Coating aid-VI | 1.8 mg/m$^2$ |
| Compound-XI | 0.27 mg/m$^2$ |
| Matting agent (polymethyl methacrylate; average particle size: 2.5 μm) | 2.5 mg/m$^2$ |

Coating aid-VI:

$C_{12}H_{25}O(CH_2CH_2O)_{10}H$

Compound-XI:

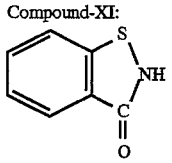

Preparation of Light-Sensitive Material:

The light-sensitive coating composition and the coating composition for a surface protective layer were applied to each side of support C by co-extrusion coating at a single spread of 1.75 g/m$^2$.

Evaluation:

Ultravision First Detail (UV) produced by E.I. Du Pont was set in contact with each side of the light-sensitive material, and both sides of the light-sensitive material were exposed for 0.05 second for X-ray sensitometry.

The exposure was adjusted by changing the distance between an X-ray tube and a cassette. The exposed material was developed with processing solutions described below by means of an automatic developing machine CEPROS-30 manufactured by Fuji Photo Film Co., Ltd. taking a dry-to-dry processing time of 30 seconds to evaluate the sensitivity. Sensitivity was expressed in terms of logarithm of the reciprocal of an exposure providing a density of fog+0.1, and a relative value was obtained taking the sensitivity of a comparative emulsion as a standard (100).

Stock processing solutions were prepared from the following components.

| Stock Developer: | |
|---|---|
| Part A: | |
| Potassium hydroxide | 330 g |
| Potassium sulfite | 630 g |
| Sodium sulfite | 255 g |
| Potassium carbonate | 90 g |
| Boric acid | 45 g |
| Diethylene glycol | 180 g |
| Diethylenetriaminepentaacetic acid | 30 g |
| 1-(N,N-Diethylamine)ethyl-5-mercaptotetrazole | 0.75 g |
| Hydroquinone | 450 g |
| 4-Hydroxymethyl-4-methyl-1-phenyl-pyrazolidone | 60 g |
| Water | to make 4125 ml |
| Part B: | |
| Diethylene glycol | 525 g |
| 3,3'-Dithiobishydrocinnamic acid | 3 g |
| Glacial acetic acid | 102.6 g |
| 2-Nitroindazole | 3.75 g |
| 1-Phenyl-3-pyrazolidone | 34.5 g |
| Water | to make 750 ml |

-continued

| Stock Developer: | |
|---|---|
| Part C: | |
| Glutaraldehyde (50% solution) | 150 g |
| Potassium bromide | 15 g |
| Sodium metabisulfite | 105 g |
| Water | to make 750 ml |

| Stock Fixer: | |
|---|---|
| Ammonium thiosulfate (70 wt/v %) | 3000 ml |
| Disodium ethylenediaminetetraacetate dihydrate | 0.45 g |
| Sodium sulfite | 225 g |
| Boric acid | 60 g |
| 1-(N,N-Diethylamine)-ethyl-5-mercaptotetrazole | 15 g |
| Tartaric acid | 48 g |
| Glacial acetic acid | 675 g |
| Sodium hydroxide | 225 g |
| Sulfuric acid (36N) | 58.5 g |
| Aluminum sulfate | 150 g |
| Water | to make 6000 ml pH = 4.68 |

The stock developer was packed in a container composed of three packs for parts A, B and C, respectively, which were connected into one body.

The stock fixer was put in a separate container of the same type.

To begin with, 300 ml of an aqueous solution containing 54 g of acetic acid and 55.5 g of potassium bromide was put as a starter in a developing tank.

The container containing the stock solution was fitted upside down to a stock tank provided on the side of an automatic developing machine, whereby the piercing blade pierced the sealing film of the pack to fill the stock tank with the stock solution.

Each of the stock developer and the stock fixer in the respective stock tank was diluted with water at the following ratio and charged into a developing tank and a fixing tank by means of a separate pump. The tanks were replenished with the processing solutions (similarly diluted with water) for every processing throughput corresponding to 8 films of JS(10x12) unit size (10"×12").

| Developer: | |
|---|---|
| Part A | 51 ml |
| Part B | 10 ml |
| Part C | 10 ml |
| Water | 125 ml |
| pH | 10.50 |

| Fixer: | |
|---|---|
| Concentrated fixer | 80 ml |
| Water | 120 ml |
| pH | 4.62 |

A washing tank was filled with tap water.

Three polyethylene bottles were each filled with 0.4 g of a fur preventive comprising perlite having an average particle size of 100 μm and an average pore size of 3 μm having supported thereon actinomycetes, and the opening of the bottle was covered with 300 mesh nylon cloth, through which water and the bacteria might pass. Two of them were sunk in the washing tank, and one in the stock tank (0.2 l) of washing water.

| Processing Speed and Temperature: | | |
|---|---|---|
| Development | 35° C. | 8.8 sec |
| Fixing | 32° C. | 7.7 sec |
| Washing | 17° C. | 3.8 sec |
| Squeegeeing | | 4.4 sec |
| Drying | 58° C. | 5.3 sec |
| Total | | 30 sec |
| Replenishment rate: | | |
| Developer | 25 ml/10" × 12" | |
| Fixer | 25 ml/10" × 12" | |

The light-sensitive material was exposed to X-ray using fluorescent intensifying screens described in JP-A-6-11804. As a result, satisfactory X-ray image was obtained.

Comparison between emulsions A and B with emulsion C in terms of grain shape characteristics, it is surprisingly seen that grains in emulsions A and B showed growth while maintaining small thickness, proving superior anisotropy in growth as compared with the grains of emulsion Co It is also seen that emulsion B is superior to emulsion A in growth anisotropy. From these considerations, it is understood that size control of fine grains used in the grain growth system is of great significance.

Comparison between emulsion D with emulsion E in terms of grain shape characteristics, it is surprisingly seen that grains in emulsion D showed growth while maintaining small thickness, proving superior growth anisotropy as compared with the grains of emulsion E. It is thus proved important that grain growth should be carried out at a controlled feed rate so as to form new nuclei and to maintain such a state that disappearance of the new nuclei may not occur.

Comparison between emulsion F with emulsion G in terms of grain shape characteristics, it is surprisingly found that grains of emulsion F have a higher degree of monodispersion of projected area than that of emulsion G. It is thus understood that use of monodisperse seed crystals is important for forming tabular grains with good reproducibility and high degree of monodispersion.

The results of the X-ray sensitometry of emulsions A, B and C are shown in Table 6 below.

TABLE 6

| Emulsion | Relative Sensitivity | Fog |
|---|---|---|
| A | 131 | 0.03 |
| B | 142 | 0.03 |
| C | 100 (standard) | 0.03 |

It is seen from Table 6 that the light-sensitive materials A and B exhibit high sensitivity in rapid processing, while no significant difference in fog was observed therebetween. This effect was pronounced in the light-sensitive material containing emulsion B which was prepared by grain growth in the presence of fine grains at least 70% of which had a volume falling within a range of 70 to 100% of the critical grain size.

The results of the X-ray sensitometry of emulsions D and E are shown in Table 7 below.

TABLE 7

| Emulsion | Relative Sensitivity | Fog |
|---|---|---|
| D | 164 | 0.05 |
| E | 100 (standard) | 0.05 |

It is seen from Table 7 that the light-sensitive material D exhibits high sensitivity in rapid processing, while no significant difference in fog was observed therebetween.

The results of the X-ray sensitometry of emulsions F and G are shown in Table 8 below.

TABLE 8

| Emulsion | Relative Sensitivity | Fog |
|---|---|---|
| F | 119 | 0.03 |
| G | 100 (standard) | 0.03 |

It is seen from Table 8 that the light-sensitive material F exhibits high sensitivity in rapid processing, while no significant difference in fog was observed therebetween.

EXAMPLE 8

Experiments were conducted in the same manner as in Example 7 except for replacing selenium compound-I as used in emulsions A to G with tellurium compound-I. The results verified that the light-sensitive materials containing the emulsion of the present invention exhibit high sensitivity in rapid processing irrespective of whether the sensitization of the emulsion was conducted with a selenium compound or a tellurium compound.

While the invention has been described in detail and with reference to specific embodiments thereof, it will be apparent to one skilled in the art that various changes and modifications can be made therein without departing from the spirit and scope thereof.

What is claimed is:

1. A process for producing a silver halide emulsion, which comprises:

(1) forming silver halide nuclei in an aqueous medium;

(2) introducing a halogen composition gap onto said nuclei sufficient to impart said nuclei with the capability of being grown anisotropically into tabular grains;

(3) adding silver ions to said medium in an amount corresponding to 1 to 10 mol% of the total silver content of the final grains, to form on the nuclei a layer of silver halide having a higher solubility than said nuclei obtained from step (2);

(4) raising the temperature by 20° to 40° C. of said medium; and (5) conducting grain growth so as to obtain silver halide grains having {100} major faces and an average aspect ratio of at least 2;

wherein said tabular grains contain at least 10 mol% of silver chloride.

2. The process for producing the silver halide emulsion according to claim 1, wherein the addition of silver ions in step (3) is conducted within 10 minutes after said introduction of the halogen composition gap in step (2).

3. The process for producing the silver halide emulsion according to claim 1, wherein said nuclei are pure silver chloride grains or silver halide grains containing not less than 10 mol% of chlorine having a coefficient of volume variation of not more than 0.2 and each having a volume of not greater than 0.001 $\mu m^3$ and said tabular grains have a coefficient of variation of not more than 0.25.

4. The process for producing the silver halide emulsion according to claim 3, wherein said nuclei have a coefficient of volume variation of not more than 0.1.

5. The process for producing the silver halide emulsion according to claim 1, wherein said tabular silver halide grains contain 20 to 99 mol% of silver chloride.

6. A silver halide photographic material comprising a support having thereon at least one layer containing a silver halide emulsion comprising tabular silver halide grains containing not less than 10 mol% of silver chloride and having {100} faces as major faces and an average aspect ratio of 2 or higher which tabular silver halide grains were prepared by the process of claim 1.

7. The process according to claim 1, wherein the amount of silver ions added in step (3) is in the range of from 1 to 10 mol%, based on the total silver content of the final grains.

8. The process according to claim 1, wherein the amount of silver ions added in step (3) is in the range of from 2 to 8 mol%, based on the total silver content of the final grains.

9. The process according to claim 1, wherein said medium has a temperature in the range of from 20° to 60° C. during said steps (1)–(3) and a temperature of 50° to 90° C. during said step (5 and said temperature during said step (5) is 20° to 40° C. higher than said temperature during said steps (1)–(3).

10. The process according to claim 1, further comprising conducting ripening after said step (4) and before said step (5).

11. The process according to claim 10, wherein said ripening step and said step (5) are each carried out at a temperature of from 50° to 90° C.

12. The process according to claim 1, wherein said step (5) is carried out in the presence of a fine grain emulsion having coefficient of grain size variation of not more than 15%.

13. The process for producing the silver halide emulsion according to claim 12, wherein said grain growth step (5) is carried out by adding fine grains, at least 90% of which are capable of disappearance and not less than 50% by number of all the added fine grains being those having a volume falling within a range of 70 to 100% of the maximum volume of the grains capable of disappearance during the grain growth.

14. The process for producing the silver halide emulsion according to claim 12, wherein grain growth in step (5), after addition of 30% of the total silver content, is carried out by adding a silver salt and a halogen salt under conditions of pCl of 1.6 or more and a temperature of 65° C. or higher at such a rate of addition that new nuclei are formed but that the new nuclei do not grow to such a size that they fail to ultimately disappear.

15. The process for producing the silver halide emulsion according to claim 14, wherein not less than 70% by number of all the added fine grains are those having a volume falling within a range of 70 to 100% of the maximum volume of the fine grains capable of disappearance during the grain growth.

16. The process according to claim 1, wherein said medium contains gelatin.

17. The process according to claim 1, wherein halide ions are also added with said silver ions during step (3).

18. A silver halide photographic material comprising a support having on each side thereof a layer containing a silver halide emulsion comprising tabular silver halide grains containing not less than 10 mol% of silver chloride and having {100} faces as major faces and an average aspect ratio of 2 or higher which tabular silver halide grains were prepared by the process of claim 1.

* * * * *